US009211970B2

(12) United States Patent
Hubbard, Jr. et al.

(10) Patent No.: US 9,211,970 B2
(45) Date of Patent: Dec. 15, 2015

(54) FOOD TRAY

(71) Applicant: LBP Manufacturing, Inc., Cicero, IL (US)

(72) Inventors: James A. Hubbard, Jr., Oak Lawn, IL (US); Matthew R. Cook, Oak Brook, IL (US); Thomas Fu, Naperville, IL (US); Kurt Wolf, Chicago, IL (US)

(73) Assignee: LBP Manufacturing LLC, Cicero, IL (US)

( * ) Notice: Subject to any disclaimer, the term of this patent is extended or adjusted under 35 U.S.C. 154(b) by 0 days.

(21) Appl. No.: 13/897,196

(22) Filed: May 17, 2013

(65) Prior Publication Data

US 2013/0341386 A1 Dec. 26, 2013

Related U.S. Application Data

(63) Continuation-in-part of application No. 13/463,479, filed on May 3, 2012, which is a continuation-in-part of application No. 13/165,346, filed on Jun. 21, 2011.

(60) Provisional application No. 61/356,847, filed on Jun. 21, 2010.

(51) Int. Cl.
*B65D 5/24* (2006.01)
*B65D 5/28* (2006.01)
(Continued)

(52) U.S. Cl.
CPC ..... *B65D 5/2057* (2013.01); *B65D 5/2047* (2013.01); *B65D 5/24* (2013.01); *B65D 5/28* (2013.01); *B65D 5/6644* (2013.01)

(58) Field of Classification Search
CPC .. B65D 5/2057; B65D 5/2047; B65D 5/6644; B65D 5/24; B65D 5/28
USPC ..... 229/128, 148, 149, 150, 152, 153, 154, 229/186, 223, 114, 157, 162.1, 162.7
See application file for complete search history.

(56) References Cited

U.S. PATENT DOCUMENTS 292,654 A 1/1884 Jaeger
306,532 A 10/1884 Schmidt
(Continued)

FOREIGN PATENT DOCUMENTS

EP 657359 9/1998
FR 1125835 A * 11/1956 ..... B65D 5/2047
(Continued)

OTHER PUBLICATIONS

Photo of food box believed to have been taken prior to Jun. 21, 2010.
(Continued)

*Primary Examiner* — Gary Elkins
(74) *Attorney, Agent, or Firm* — Fitch, Even, Tabin & Flannery LLP

(57) ABSTRACT

A food tray formed of a unitary sheet of material includes a bottom wall, a front wall, a rear wall, first sidewall, and a second sidewall that define an opening through which an item is placed in the food tray. First and second flaps extend from respective top edges of the first and second sidewalls and are configured to be folded toward an interior of the food tray. The first and second flaps each define slots. First and second lid members extend from respective top edges of the front wall and the rear wall and are configured to be folded toward the interior of the food tray. The first and second lid members define a pair of tabs on respective side edges that are configured to engage the slots defined by the first and second flaps.

16 Claims, 18 Drawing Sheets

(51) Int. Cl.
*B65D 5/20* (2006.01)
*B65D 5/66* (2006.01)

(56) References Cited

U.S. PATENT DOCUMENTS

| | | | | | |
|---|---|---|---|---|---|
| 667,634 | A | | 2/1901 | Schmidt | |
| 926,208 | A | | 6/1909 | Palmer | |
| 1,440,233 | A | | 12/1922 | Noel | |
| 2,072,753 | A | | 3/1937 | Ikeda | |
| 2,110,681 | A | | 3/1938 | Rutledge | |
| 2,361,124 | A | | 9/1942 | Ringholz | |
| 2,330,521 | A | * | 9/1943 | Scheide | 229/157 |
| 2,493,176 | A | | 1/1950 | Whitehead | |
| 2,536,948 | A | | 1/1951 | Lehman | |
| 2,675,160 | A | * | 4/1954 | Buttery | 229/148 |
| 2,805,813 | A | | 9/1957 | Rittmueller | |
| 2,854,182 | A | * | 9/1958 | Dodd | 229/149 |
| 2,909,105 | A | | 10/1959 | Lawrence | |
| 3,038,650 | A | * | 6/1962 | Asman | 229/162.7 |
| 3,067,924 | A | * | 12/1962 | Baker et al. | 229/157 |
| 3,105,626 | A | | 10/1963 | McCormick | |
| 3,126,142 | A | | 3/1964 | Goetz | |
| 3,176,899 | A | | 4/1965 | McMahon | |
| 3,231,172 | A | * | 1/1966 | Strange | 229/223 |
| 3,330,467 | A | | 7/1967 | Johnson | |
| 3,343,660 | A | | 9/1967 | Bailey | |
| 3,603,502 | A | * | 9/1971 | Howard et al. | 229/149 |
| 3,670,949 | A | | 6/1972 | Galanes | |
| 3,809,310 | A | | 5/1974 | VanderLugt | |
| 3,949,931 | A | | 4/1976 | Hall | |
| D259,615 | S | | 6/1981 | Morris, Jr. | |
| 4,291,806 | A | | 9/1981 | Austin | |
| 4,747,536 | A | | 5/1988 | Wischusen | |
| 4,917,291 | A | | 4/1990 | Saiki | |
| 5,226,588 | A | | 7/1993 | Schramm | |
| D348,607 | S | | 7/1994 | Young | |
| 5,370,303 | A | | 12/1994 | Fry | |
| 5,411,204 | A | | 5/1995 | DeMay | |
| 5,415,340 | A | * | 5/1995 | Calvert et al. | 229/186 |
| 5,431,333 | A | | 7/1995 | Lorenz | |
| 5,620,134 | A | | 4/1997 | Gulliver | |
| 5,800,061 | A | | 9/1998 | Voiles | |
| 6,036,085 | A | | 3/2000 | Tsao | |
| 6,050,483 | A | | 4/2000 | Haraldsson et al. | |
| 6,223,979 | B1 | | 5/2001 | Correll | |
| 6,543,679 | B2 | | 4/2003 | Cai et al. | |
| 6,676,010 | B1 | * | 1/2004 | Roseth et al. | 229/114 |
| D495,251 | S | | 8/2004 | Zack | |
| D519,366 | S | | 4/2006 | Epstein | |
| D552,987 | S | | 10/2007 | Magnusson | |
| 7,587,883 | B2 | | 9/2009 | Cook et al. | |
| 7,878,146 | B2 | | 2/2011 | Vadis | |
| 7,980,452 | B2 | | 7/2011 | Burton | |
| 8,109,433 | B2 | | 2/2012 | De Paula | |
| 2001/0004088 | A1 | | 6/2001 | Lau | |
| 2004/0178252 | A1 | | 9/2004 | Stone | |
| 2004/0182916 | A1 | | 9/2004 | Roseth | |
| 2009/0039144 | A1 | | 2/2009 | Hooi | |
| 2010/0065620 | A1 | | 3/2010 | Smith | |
| 2012/0261298 | A1 | | 10/2012 | Hubbard | |

FOREIGN PATENT DOCUMENTS

| | | |
|---|---|---|
| GB | 693179 | 6/1953 |
| GB | 875653 | 8/1961 |
| GB | 2427399 | 12/2006 |
| WO | 2008001650 | 1/2008 |

OTHER PUBLICATIONS

Notification of Transmittal of the International Search Report and the Written Opinion of the International Searching Authority, or the Declaration from the International Bureau of WIPO for International Application No. PCT/US2014/038429 dated Sep. 30, 2014, 3 pages.
Examination Report issued in related Canadian Application No. 2,780,514 dated May 28, 2015 (3 pages).

* cited by examiner

FOOD TRAY

RELATED APPLICATIONS

This application is a continuation-in-part application of U.S. application Ser. No. 13/463,479, filed May 3, 2012, which is a continuation-in-part application of U.S. application Ser. No. 13/165,346, filed Jun. 21, 2011, which claims priority to U.S. Provisional Application No. 61/356,847, filed Jun. 21, 2010, the contents of all of which are hereby incorporated by reference.

BACKGROUND

Typical food trays are made from a single piece of cardboard that is folded to form a container for storing food items. For example, a fast-food restaurant may package a hamburger in a food tray. A caterer catering to an office may place a sandwich, a bag of chips, and a cookie in a food tray.

Typical food trays are made from a single piece of cardboard that is folded into a configuration that provides a container with a lid. The container is sized to protect the food item during handling. The lid typically includes locking tabs that engage complementary locking means on the container when the lid is closed.

One problem with food trays is that they can tend to get soggy due to the humidity and heat produced by the food item. Another problem is that the lid may have a tendency to move into the closed position after being opened due to the elastic nature of the cardboard.

BRIEF SUMMARY

In a first aspect, a food tray formed of a unitary sheet of material includes a bottom, a front wall with a distal end and a proximal end, and a rear wall with a distal end and a proximal end. A first sidewall extends between the distal end of the front wall and the distal end of the rear wall, and a second sidewall that extends between the proximal end of the front wall and the proximal end of the rear wall. The front wall, rear wall, first sidewall, and second sidewall define an opening through which an item is placed in the food tray. First and second flaps extend from respective top edges of the first and second sidewall and are configured to be folded toward an interior of the food tray. Each of the first and second flaps defines a slot. A lid member extends from a top edge of the rear wall. The lid member is configured to be folded toward the interior of the food tray. The lid member defines a pair of tabs on respective side edges of the lid member that are configured to engage the slots defined by the first and second flaps when the lid is folded over the opening to thereby secure the lid member to the first and second flaps. A third flap extends from an edge of the lid member that is opposite the top edge of the rear wall. The third flap is configured to be folded about the edge when the lid member so that when the lid member is secured to the first and second flaps, the third flap is disposed in the interior of the food tray. The edge from which the third flap extends defines a slot in a middle region that is configured to receive a slot that extends from a top edge of the front wall to secure the lid member to the front wall. The lid member and rear wall define an opening. A clear material spans the opening to facilitate viewing of an item within the food tray through the both the lid member and the rear wall.

In a second aspect, a food tray formed of a unitary sheet of material includes a bottom, a front wall with a distal end and a proximal end, and a rear wall with a distal end and a proximal end. A first sidewall extends between the distal end of the front wall and the distal end of the rear wall, and a second sidewall that extends between the proximal end of the front wall and the proximal end of the rear wall. The front wall, rear wall, first sidewall, and second sidewall define an opening through which an item is placed in the food tray. The first and second flaps extend from respective top edges of the first and second sidewalls, the first and second flaps configured to be folded toward an interior of the food tray. A lid member extends from a top edge of the rear wall. The lid member is configured to be folded toward the interior of the food tray. A third flap extends from an edge of the lid member that is opposite the top edge of the rear wall. The third flap includes a tear strip that extends along a length of the third flap that is parallel to the edge. The third flap is configured to be folded about the edge of the lid member that is opposite the top edge of the rear wall when the lid member is folded toward the interior of the food tray, and secured to an outside surface of the front wall via an adhesive strip. The tear strip is configured to facilitate tearing of the third flap to facilitate opening of the lid member. The lid member and rear wall define an opening. A clear material spans the opening to facilitate viewing of an item within the food tray through the both the lid member and the rear wall.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE DRAWINGS

The exemplary embodiments below describe a food tray for storing and/or serving a food item. The food tray includes a first lid member and second lid member that are attached to a front wall and rear wall, respectively. The edges between the respective lid members and walls are bowed so that tension is produced in the front wall and rear wall when the respective lid members are placed in a closed configuration. The lid members are held in place by a group of tabs that engage a pair of slots in first and second sidewalls of the food tray. The slots and tabs cooperate to prevent the lid members from opening under the tension. When the first and second sidewalls are spread apart, the tabs are released from the slots, and tension in the front and rear walls causes the lid members to automatically open.

Figure 1:
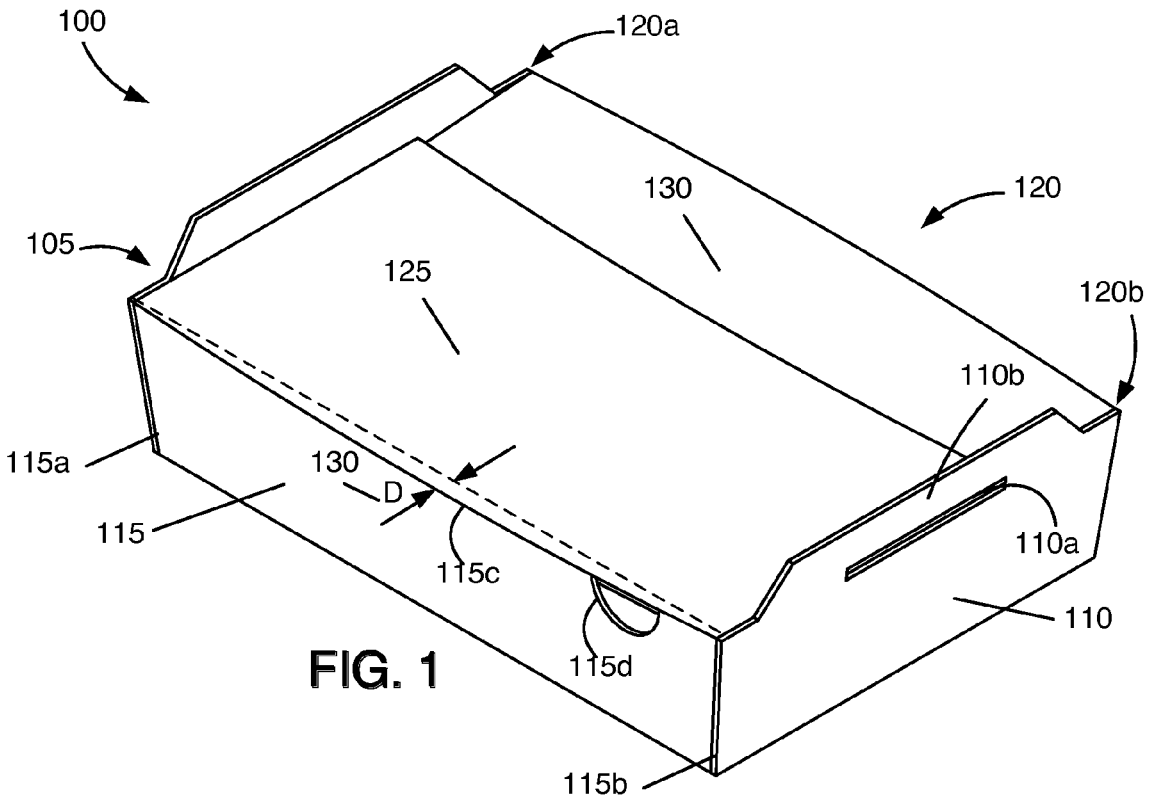
FIG. 1 illustrates a perspective view of a food tray.

FIG. 1 illustrates a perspective view of a food tray 100. The food tray 100 includes a first sidewall 105, a second sidewall 110, a front wall 115, a rear wall 120, a first lid member 125, and a second lid member 130. The first sidewall 105 extends between the distal end 115*a* of the front wall 115 and the distal end 120*a* of the rear wall 120. The second sidewall 110 extends between the proximal end 115*b* of the front wall 115 and the proximal end 120*b* of the rear wall 120.

Figure 6:
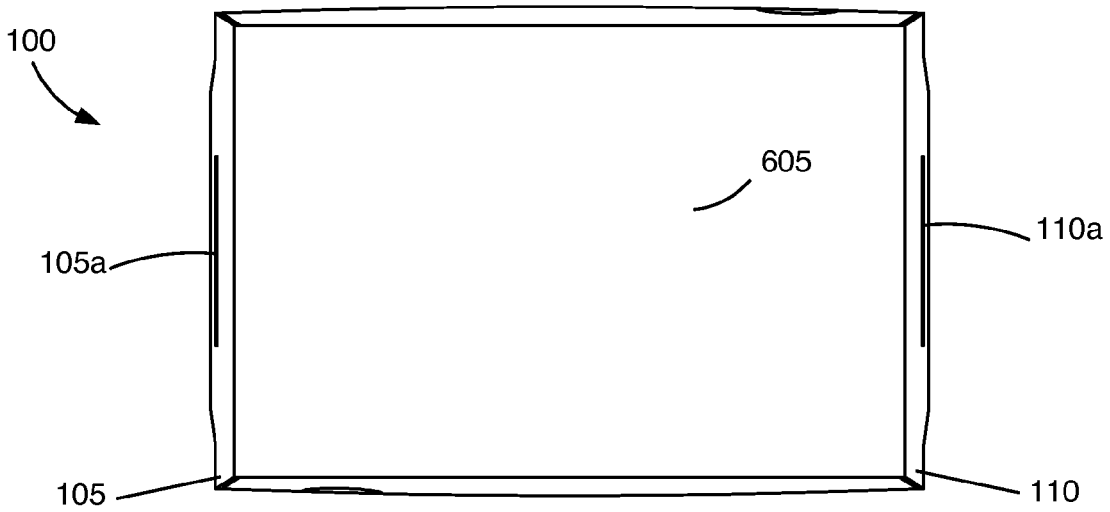

A bottom surface 605 (FIG. 6) extends between respective bottom edges of the first sidewall 105, second sidewall 110, front wall 115, and rear wall 120 to define the bottom of the food tray 100. Respective top edges of the first sidewall 105, second sidewall 110, front wall 115, and rear wall 120 define an opening through which a food item may be placed in the food tray 100.

In some implementations, the first sidewall 105, second sidewall 110, front wall 115, and rear wall 120 are tapered to enable stacking of the food tray 100. For example, the angle between each respective wall and a line that is normal to the bottom surface 605 of the food tray may be greater than 0°.

In yet other implementations, the front wall 115 and/or the rear wall 120 define openings 115*d* and 120*d* that enable venting the food tray. The openings 115*d* and 120*d* may be defined by way of perforated edges that enable a user to push out or otherwise remove a portion of the front wall 115 and/or the rear wall 120 to reveal the openings 115*d* and 120*d*.

Figure 7:
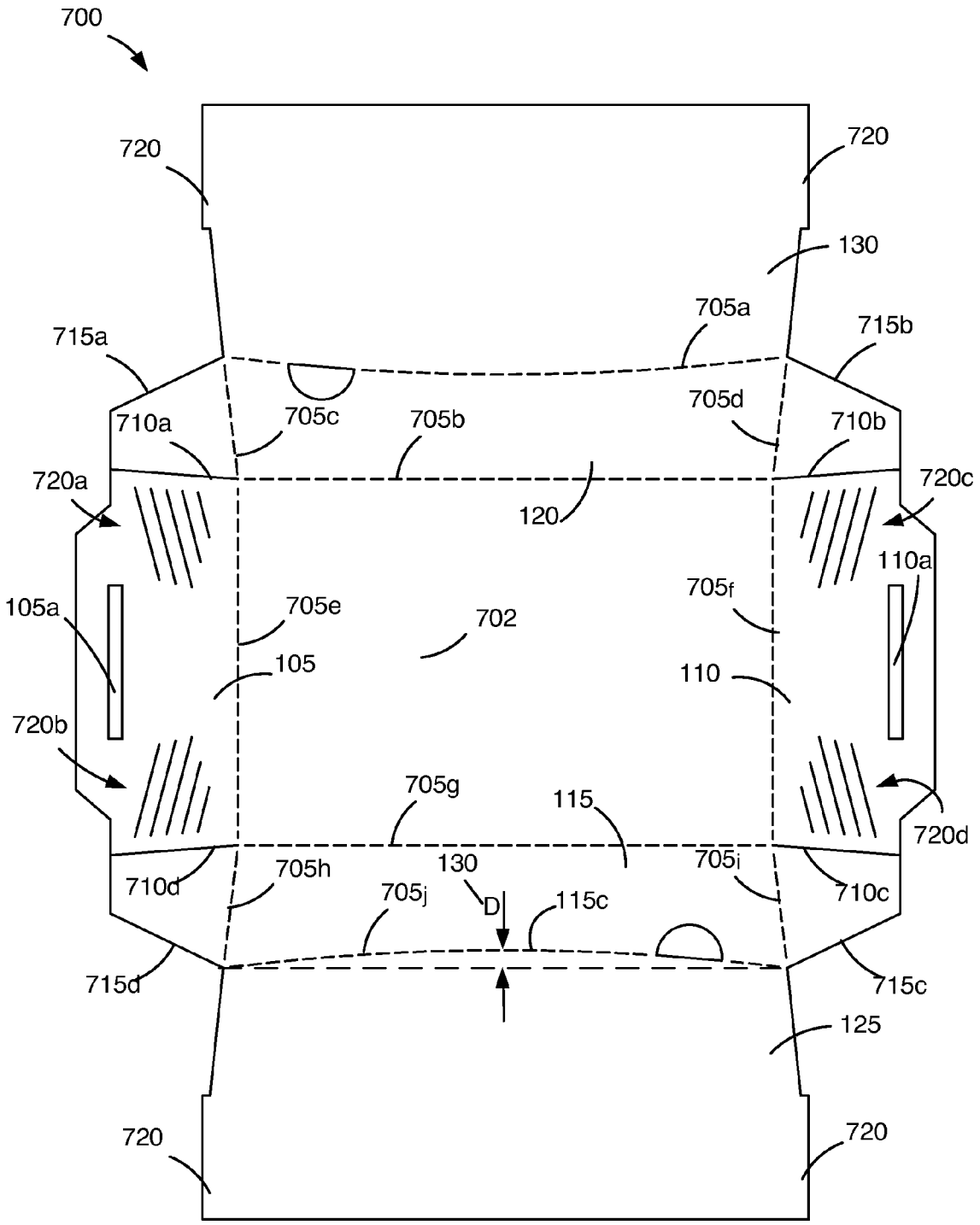
FIG. 7. illustrates a sheet that defines the various members of the food tray of FIG. 1 in an unassembled configuration.

The first lid member 125 extends from the top edge of the front wall 115, and the second lid member 130 extends from the top edge of the rear wall 120, as shown in FIG. 1 and more clearly in FIG. 7.

As shown in FIG. 7, the first lid member 125 and the second lid member 130 each define a pair of tabs 720 that are configured to engage the slots 105*a* and 110*a* defined by the first and second sidewalls 105 and 110 when the respective lid members 125 and 130 are folded to cover the opening. The length of the tabs 720 may be configured to match the length of the slots 105*a* and 110*a* so that when the lid members 125 and 130 are folded to cover the opening, the lid members 125 and 130 are substantially prevented from moving in a lateral direction.

Figure 2:
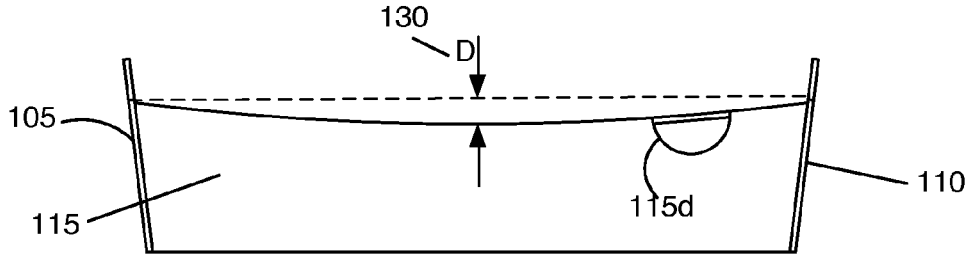
FIGS. 2 and 3 illustrate front and back views, respectively, of the food tray of FIG. 1.
Figure 3:
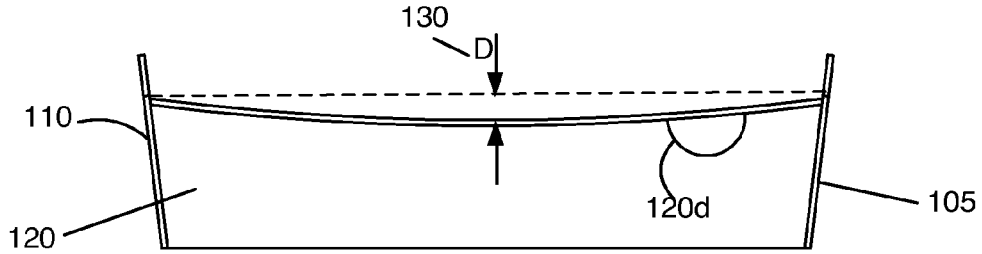
Figure 4:
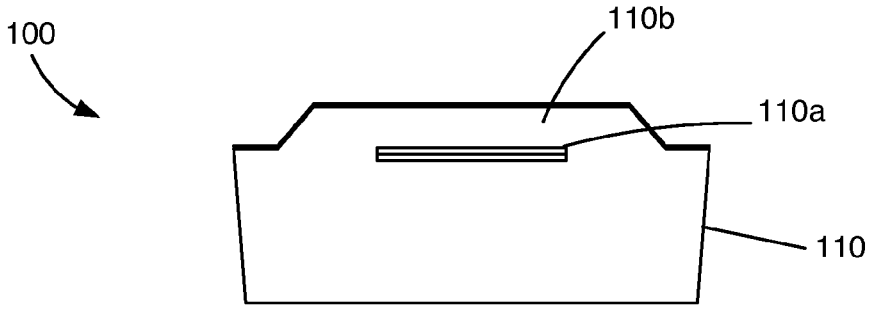
FIG. 4 illustrates a side view of the food tray of FIG. 1.
Figure 5:
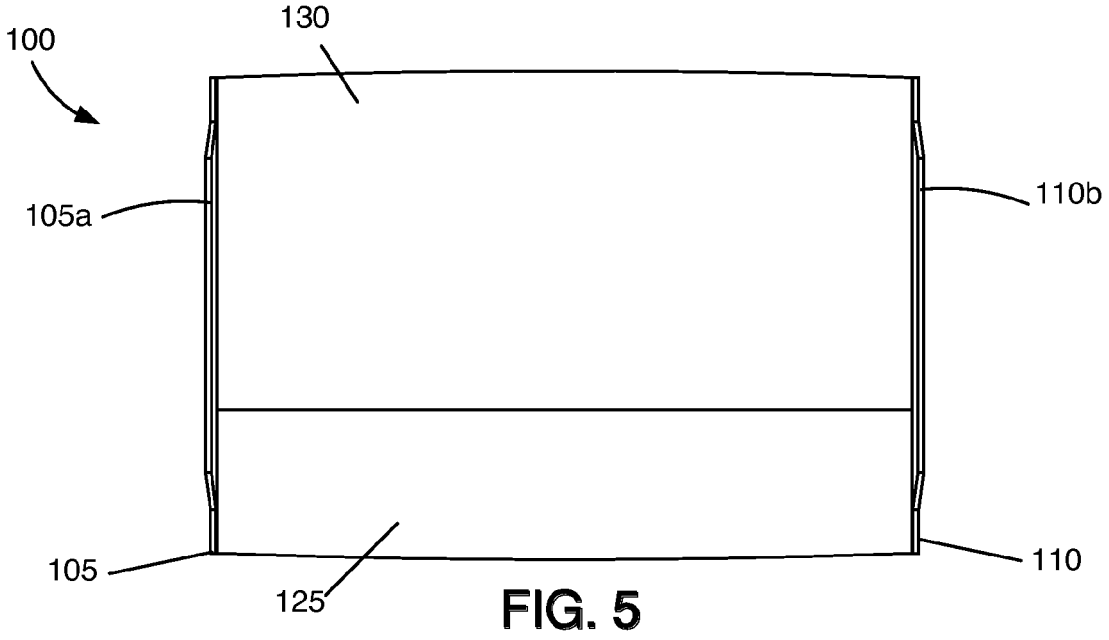
FIGS. 5 and 6 illustrate top and bottom views, respectively, of the food tray of FIG. 1.

As illustrated by FIGS. 1-3, when the first lid member 125 is closed, the front wall 115 is bowed so that a center region of the top edge 115*c* of the front wall 115 is spaced apart from a line that extends between the distal end 115*a* and the proximal end 115*b* by a distance D 130. For example, the distance D 130 may correspond to about 0.5 inches or a different distance. In some embodiments, the rear wall 120 is bowed in a similar manner when the second lid member 130 is closed.

Bowing of the front wall 115 and the rear wall 120 provides an elastic force that causes the first and second lid members 125 and 130 to open on their own when the extensions 105*b* and 110*b* on the first and second sidewalls 105 and 110 are pulled apart to release the tabs 720 on the first and the second lid members 125 and 130. Stated differently, when the first and second lid members 125 and 130 are in an open position, the first and second lid members 125 and 130 lie in the same plane as the front wall and rear wall 115 and 120, respectively. In this configuration, the front wall 115 and the rear wall 120 may be generally planar and not bowed. When the first and second lid members 125 and 130 are moved into the closed configuration, tension is produced in the front wall 115 and the rear wall 120 by way of the bowing that occurs in the front wall 115 and the rear wall 120 resulting from the arc shape crease 705*a* and 705*j* (FIG. 7) that defines the separation of the first lid member 125 from the front wall 115 and the second lid 130 member from the rear wall 120. This tension causes the respective lid members 125 and 130 to automatically open when the tabs 720 are released from the slots.

As illustrated in FIG. 7, the food tray may be formed from a single sheet 700 of material, such as a corrugated paper material. The sheet 700 may define a group of creases 705*a-j* that further define the first sidewall 105, second sidewall 110, front wall 115, rear wall 120, first lid member 125, and second lid member 130.

In one embodiment, the food tray is configured by cutting the sheet along a group of cut lines 710*a-d* to separate a group of tabs 715*a-d*. Next, the sheet 700 is folded along the group of creases 705*a-j* to configure the food tray. The configuration is maintained by attaching the group of tabs 715*a-d* to the first sidewall and second sidewall. The tabs 715*a-d* may be attached to the first sidewall and second sidewall via glue strips 720*a-d* disposed on the first and second sidewalls, or in a different matter.

Figure 8A:
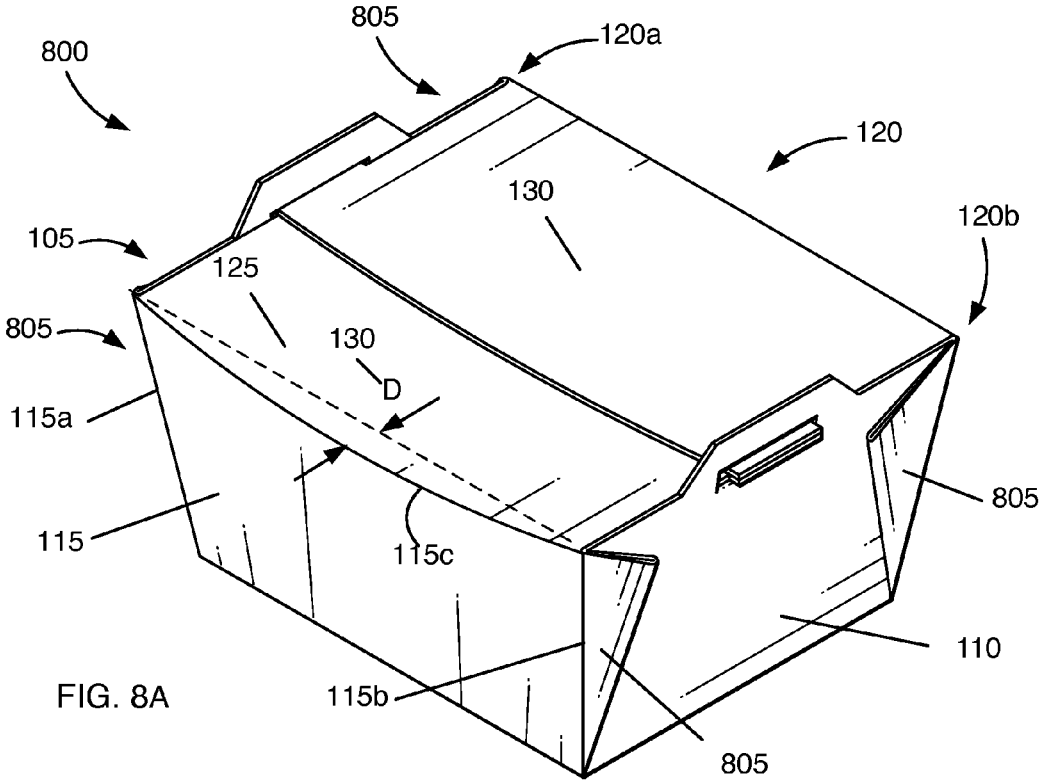
FIG. 8A illustrates a perspective view of a third embodiment of a food tray.

FIG. 8A is another of a food tray 800. The food tray 800 includes a first sidewall 105, a second sidewall 110, a front wall 115, a rear wall 120, a first lid member 125, and a second lid member 130. The respective walls and lid members may be sized and positioned relative to one another in a similar manner as the respective walls and lid members of the food tray 100 in FIG. 1. The food tray 800 may be combined with any other elements of the food tray 100 described above.

Figure 8B:
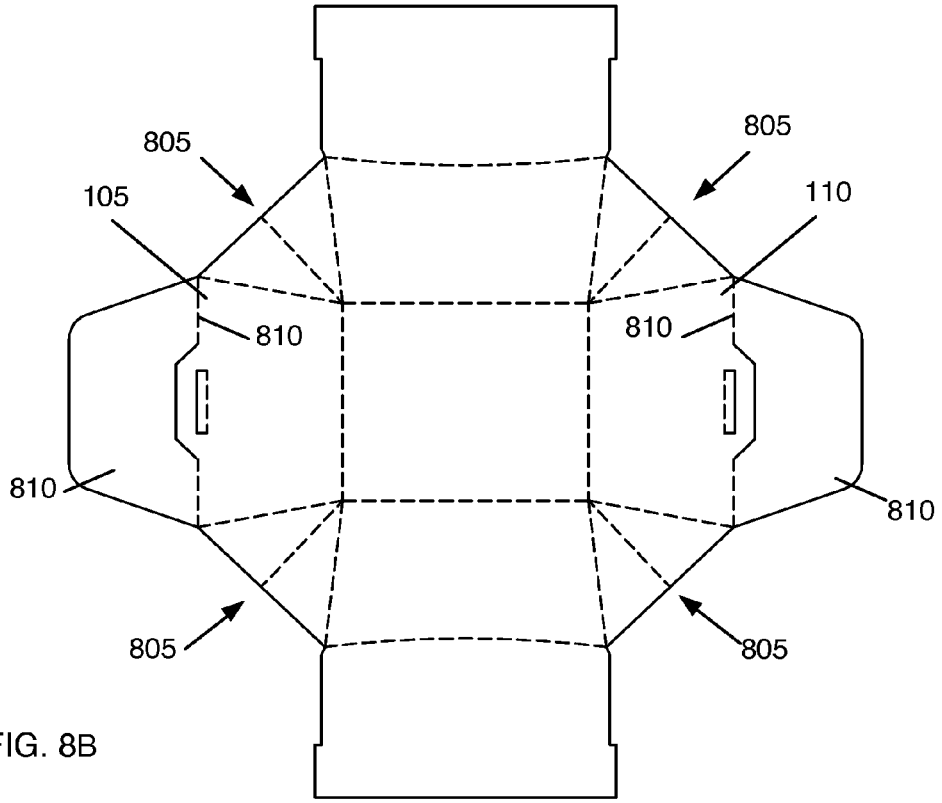
FIG. 8B illustrates the food tray of FIG. 8A in an unassembled configuration.

The food tray 800 includes a group of gussets 805 on respective corners of the food tray 800.In FIG. 8B, the gussets 805 are integrally formed with the first sidewall 105, second sidewall 110, front wall 115, and rear wall 120, respectively. The gussets 805 enable the food tray 800 to store a fluid substance without spillage. The gussets 805 may be folded so that they are positioned on the outside of the food tray 800, as shown, or on the inside of the food tray 800. The gussets 805 may be folded over the first sidewall 105 and second sidewall 110, as shown, over the front wall 115 and rear wall 120, or any combination thereof. In some implementations, an adhesive may be utilized to secure the gusset 805 to the respective sidewall. The adhesive may be pre-applied to the respective walls or the gussets 805 to enable quick assembly of the food tray 800 in a restaurant setting. The gussets 805 may also be fastened differently as described below.

In FIG. 8B, a folding portion 810 may extend from the first sidewall 105 and the second sidewall 110, respectively. In operation, the folding portion 810 is folded towards the center of the food tray 800 along a shared edge 810 with the respective sidewall 105 and 110. In this configuration, the folding portion 810 forms a shelf that extends toward the center of the food tray 800. The shelf provides support for the first lid member 130 and the second lid member 125 when the respective lid members 130 and 125 are folded to close the food tray 800.

Figure 9A:
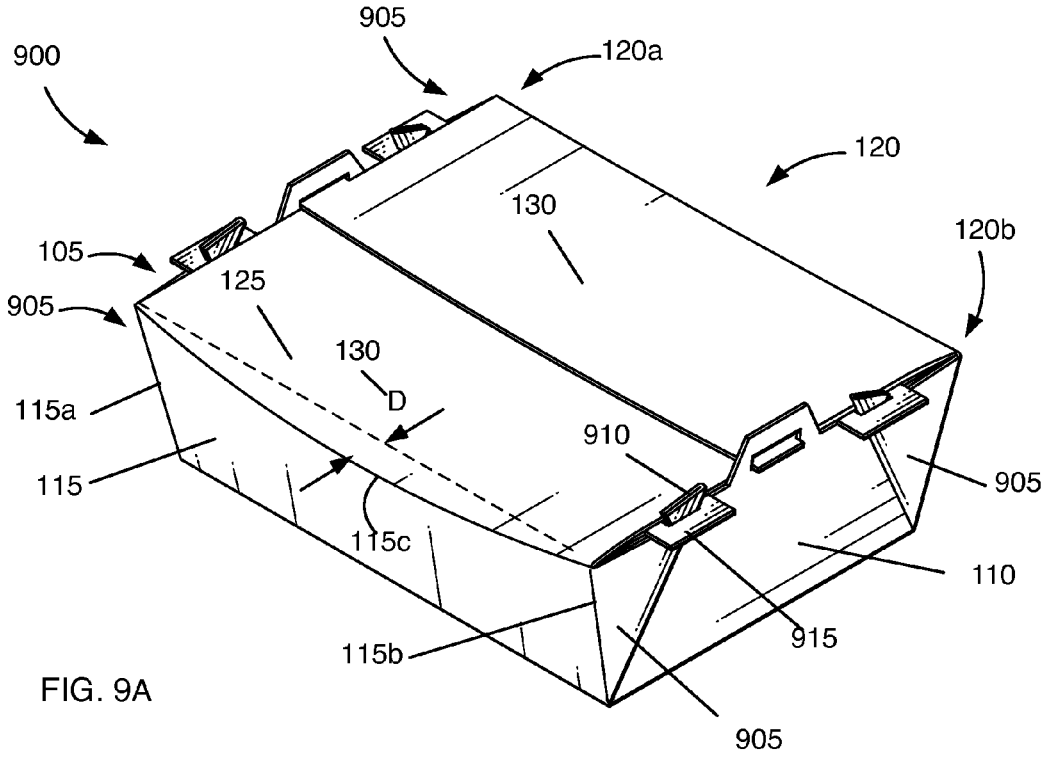
FIG. 9A illustrates a perspective view of a fourth embodiment of a food tray.

FIG. 9A is another embodiment of a food tray 900. The food tray 900 includes a first sidewall 105, a second sidewall 110, a front wall 115, a rear wall 120, a first lid member 125, and a second lid member 130. The respective walls and lid members may be sized and positioned relative to one another in a similar manner as the respective walls and lid members of the food tray 100 in FIG. 1. The food tray 900 may be combined with any other elements of the food tray 100 of FIG. 1 and/or the food tray 800 of FIG. 8, described above.

Figure 9B:
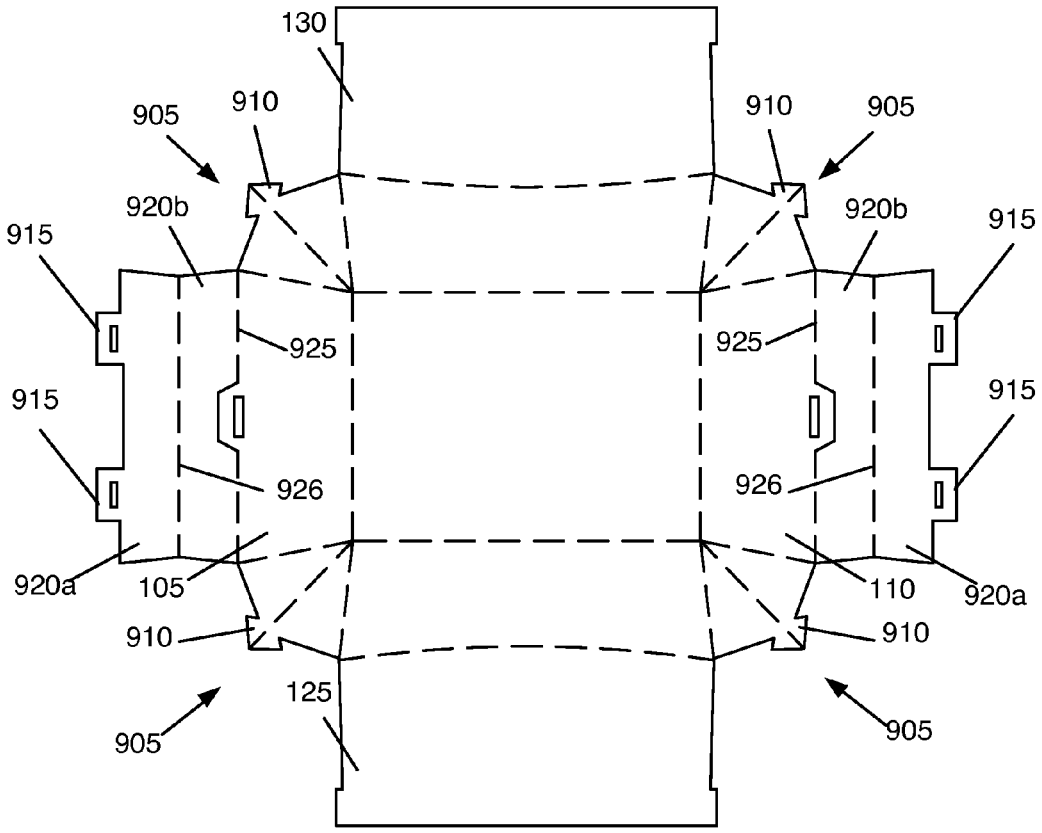
FIG. 9B illustrates the food tray of FIG. 9A in an unassembled configuration.

The food tray 900 includes a group of gussets 905 on respective corners of the food tray 900. In FIG. 9B, the gussets 905 are integrally formed with the first sidewall 105, second sidewall 110, front wall 115, and rear wall 120. The gussets 905 enable the food tray 900 to store a fluid substance without spillage. The gussets 905 may be folded so that they are positioned on the outside of the food tray 900, as shown. The gussets 905 may be folded over the first sidewall 105 and second sidewall 110, as shown, over the front wall 115 and rear wall 120, or any combination thereof.

Each gusset 905 includes a lock tab 910 positioned on a tip of the gusset 905. The lock tab 910 is configured to enter through an aperture defined by a complementary lock tab 910 that extends in a substantially perpendicular direction away from an outside surface of a sidewall 105 and 110 of the food tray 900.

In FIG. 9B, the lock tabs 915 may be integrally formed with the first sidewall 105 and the second sidewall 110, respectively. In particular, the respective lock tabs 910 may extend from a first folding portion 920*a* and a second folding portion 920*b* of the first sidewall and the second sidewall, respectively.

In operation, the second folding portion 920*b* is folded towards the center of the food tray 900 along a shared edge 925 with the respective sidewall 105 and 110. Next, the first folding portion 920*a* is folded about a shared edge 926 with the second folding portion 920*b*, so that the lock tabs 915 extend over the first sidewall 105 and the second sidewall 110, respectively to engage the lock tabs 910 of the respective gussets 905. The first folding portion 920*a* and the second folding portion 290*b* form a shelf that extends toward the center of the food tray 900. The shelf provides support for the first lid member 125 and the second lid member 130 when the respective lids 125 and 130 are folded to close the food tray 900.

Figure 10A:
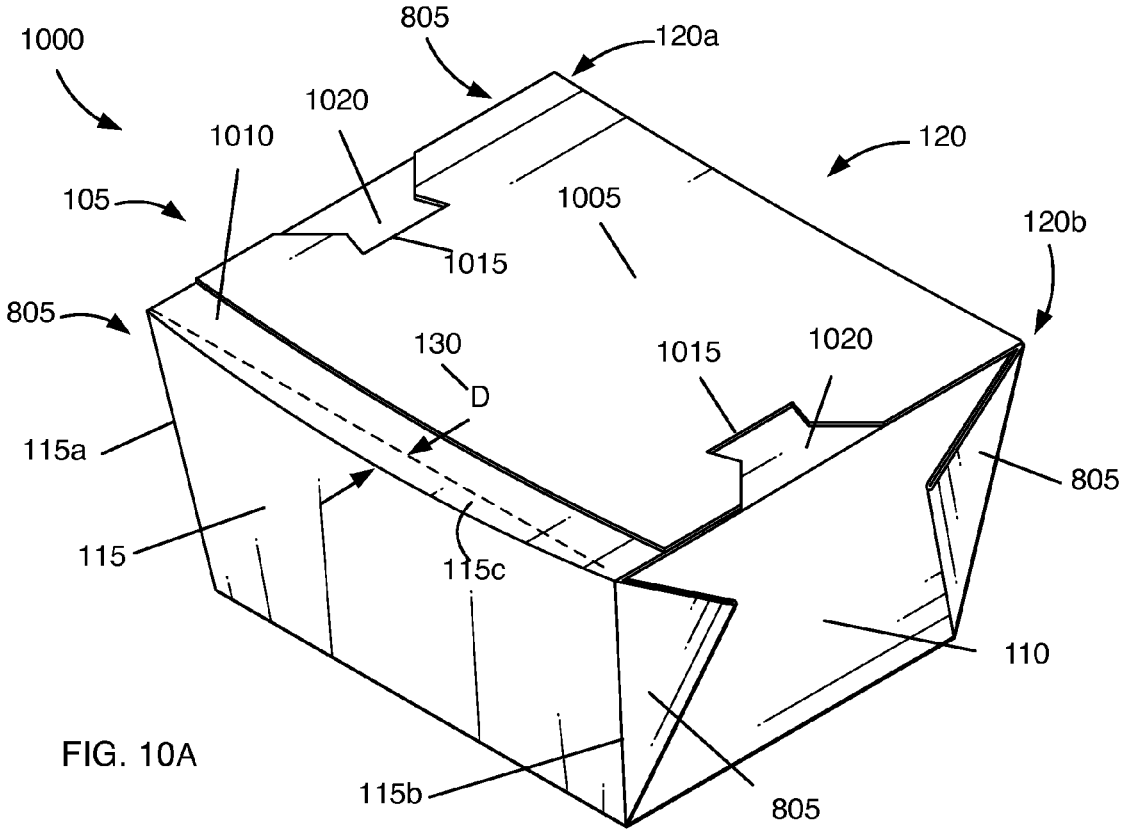
FIG. 10A illustrates a perspective view of a fifth embodiment of a food tray.

FIG. 10A is another embodiment of a food tray 1000. The food tray 1000 includes a first sidewall 105, a second sidewall 110, a front wall 115, a rear wall 120, a first lid member 1005, a second lid member 1010, and a pair of flaps 1025 extending from the first sidewall 105 and the second sidewall 110, respectively. The respective walls members may be sized and positioned relative to one another in a similar manner as the respective walls members of the food tray 100 in FIG. 1. The food tray 1000 also includes a group of gussets 805 on corners of the food tray 1000 that may be configured similar to the gussets 805 of the food tray 800 of FIG. 8A. The food tray 1000 may be combined with any other elements of the food tray 100 of FIG. 1, the food tray 800 of FIG. 8A, and/or the food tray 900 of FIG. 9A.

The first lid member 1005 and the second lid member 1010 are configured to be folded to cover a food item placed within the food tray 1000. The first lid member 1005 of the food tray 1000 defines a pair of lock tabs 1020 configured to engage a complementary pair of lock tabs 1015 defined by the flaps 1025 extending from the first sidewall 105 and the second sidewall 110, respectively. The lock tabs 1020 defined by the first lid member 1005 and the lock tabs 1015 defined by the flaps 1025 cooperate to lock the respective lid member 1005 and 1010 in a closed position.

Figure 10B:
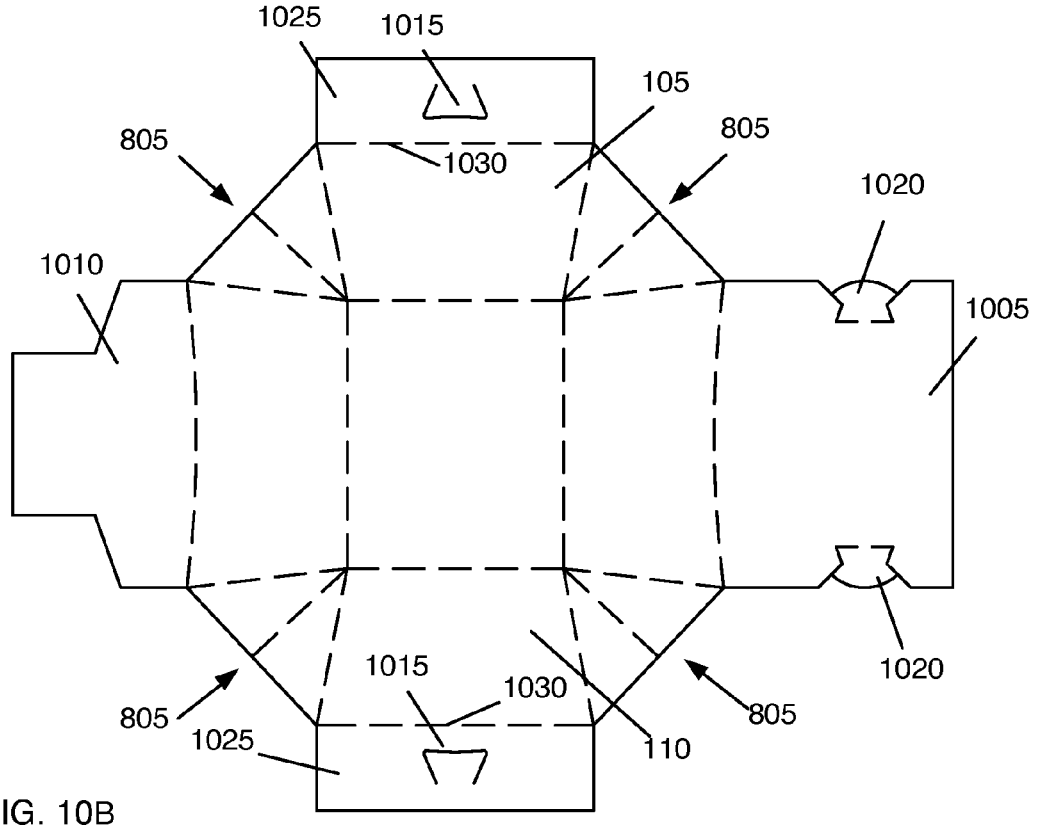
FIG. 10B illustrates the food tray of FIG. 10A in an unassembled configuration.

As shown in FIG. 10B, the lock tabs 1015 may be integrally formed with the flaps 1025.

In operation, in the assembled configuration, the flaps 1025 are folded towards the center of the food tray 1000 along a shared edge 1030 with the respective sidewalls 105 and 110. In this configuration, the flaps 1025 form a shelf that extends toward the center of the food tray 1000. The shelf provides support for the first lid member 1005 and the second lid member 1010 when the respective lid members 1005 and 1010 are folded to close the food tray 1000.

Figure 11A:
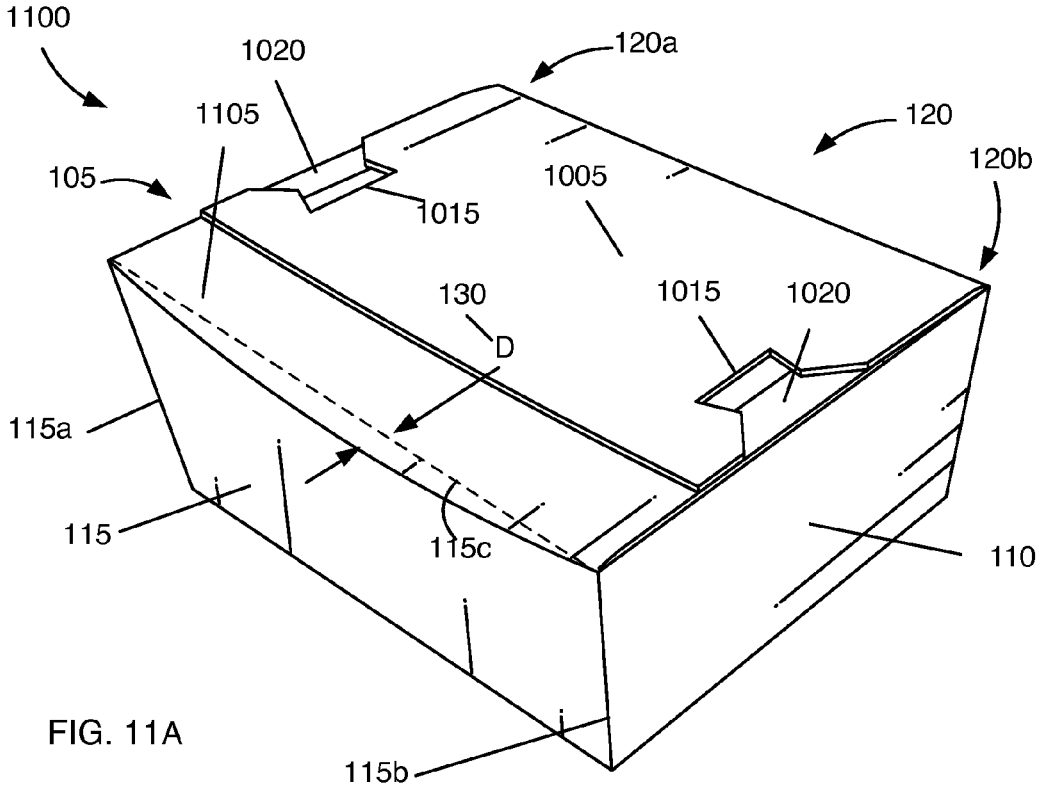
FIG. 11A illustrates a perspective view of a sixth embodiment of a food tray.

FIG. 11A is yet another embodiment of a food tray 1100. The food tray 1100 includes a first sidewall 105, a second sidewall 110, a front wall 115, a rear wall 120, a first lid member 1005, a second lid member 1105, and a pair of flaps 1025. The respective wall members may be sized and positioned relative to one another in a similar manner as the respective wall members of the food tray 1000 in FIGS. 10A and 10B. The food tray 1000 may be combined with any other elements of the food trays described above.

Figure 11B:
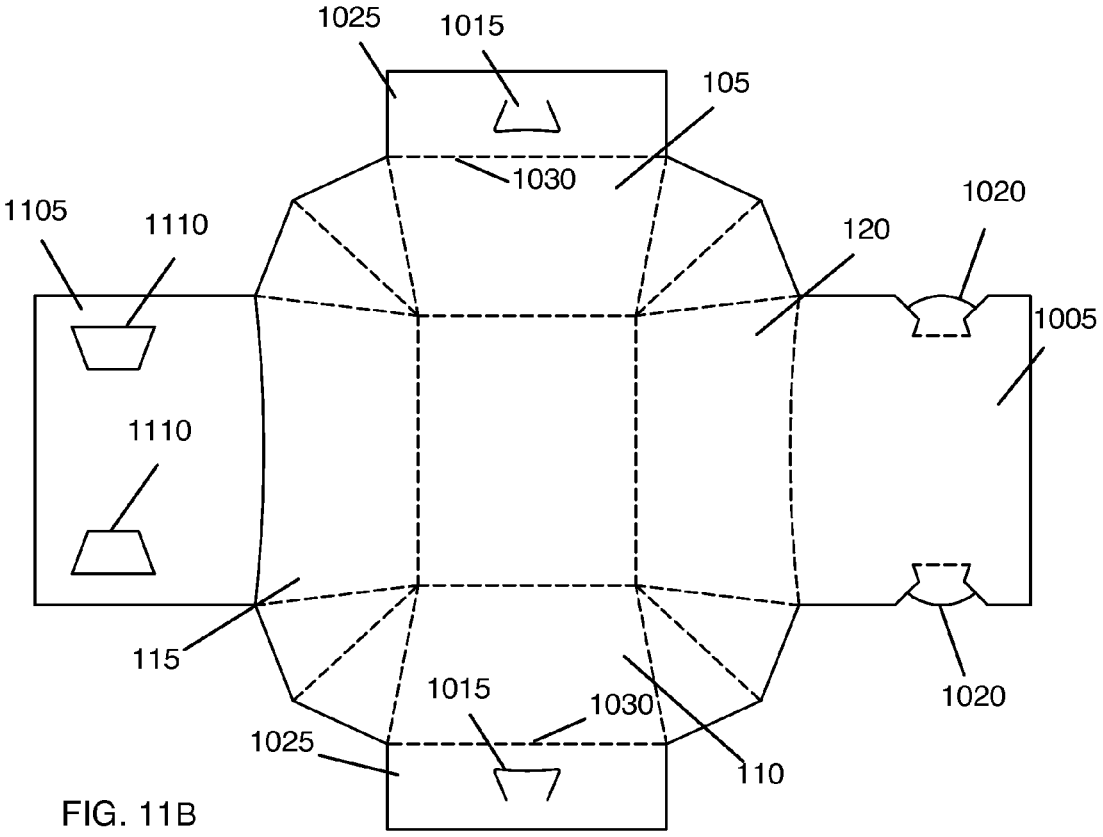
FIG. 11B illustrates the food tray of FIG. 11A in an unassembled configuration.

The first lid member 1005 and the second lid member 1105 are configured to be folded to cover a food item placed within the food tray 1100. The first lid member 1005 of the food tray 1000 defines a pair of lock tabs 1020 configured to pass through a respective pair of openings 1110 (FIG. 11B) defined by the second lid member 1105 to engage a complementary pair of lock tabs 1015 defined by the flaps 1025. The lock tabs 1020 defined by the first lid member 1005 and the lock tabs 1015 defined by the flaps 1025 cooperate to lock the respective lid member 1005 and 1010 in a closed position.

In operation, in the assembled configuration, the flaps 1025 are folded towards the center of the food tray 1000 along a shared edge 1030 with the respective sidewall 105 and 110. Next the second lid member 1105 is folded about a shared edge with the front wall 115. In this configuration, the lock tabs 1015 on the flaps 1025 are positioned below the openings 1110. Next, the first lid member 1005 is folded over the second lid member 1105. The lock tabs 1020 defined by the first lid member 1005 are then inserted through the openings 1110 defined by the second lid member 1105 so as to engage the lock tabs 1015 defined by the flaps 1025. In this configuration, the flaps 1025, first lid member 1005 and second lid member 1105 cooperate to provide a top surface capable of supporting additional food trays 1100. For example, the second lid member 1105 is substantially prevented from being pushed into the cavity of the food tray because the respective locking tabs 1015 and 1020 engage one another by passing through the openings 1110. This, in turn enables the food tray 1100 to support the weight of additional food trays with food items stored therein as is the case when food trays are stacked.

Figure 12A:
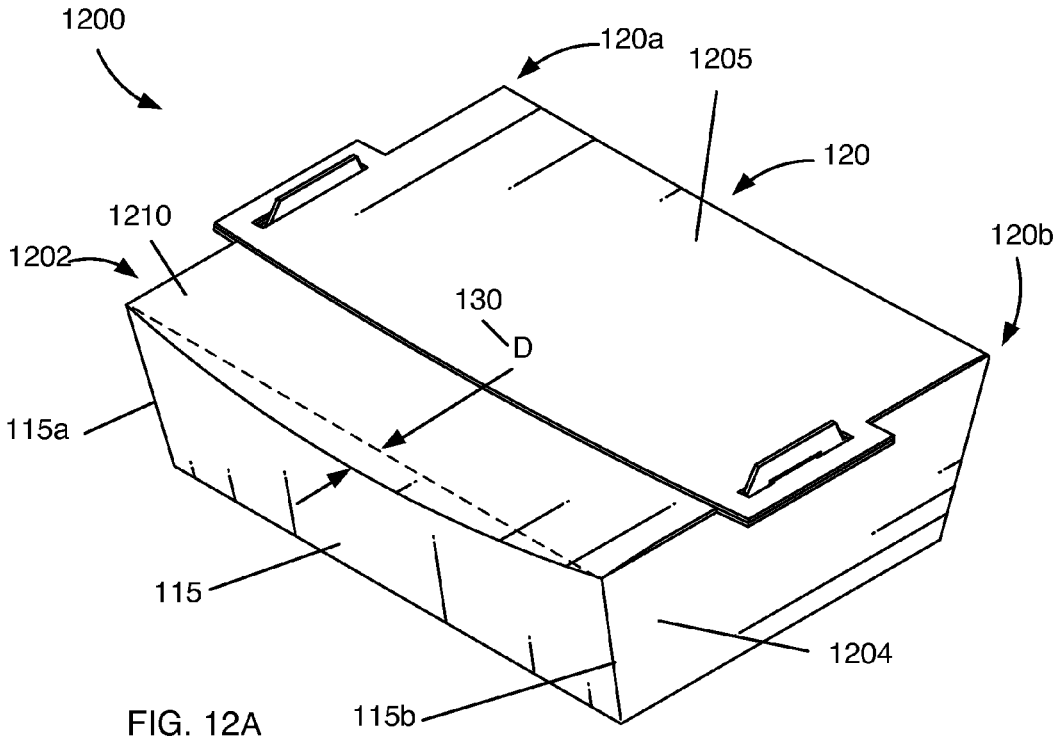
FIG. 12A illustrates a perspective view of a seventh embodiment of a food tray.

FIG. 12A is yet another embodiment of a food tray 1200. The food tray 1200 includes a first sidewall 1202, a second sidewall 1204, a front wall 115, a rear wall 120, a first lid member 1205, and a second lid member 1210. The respective walls members may be sized and positioned relative to one another in a similar manner as the respective walls members of the food tray 100 in FIG. 1. The food tray 1200 may be combined with any other elements of the various food trays described above.

Figure 12B:
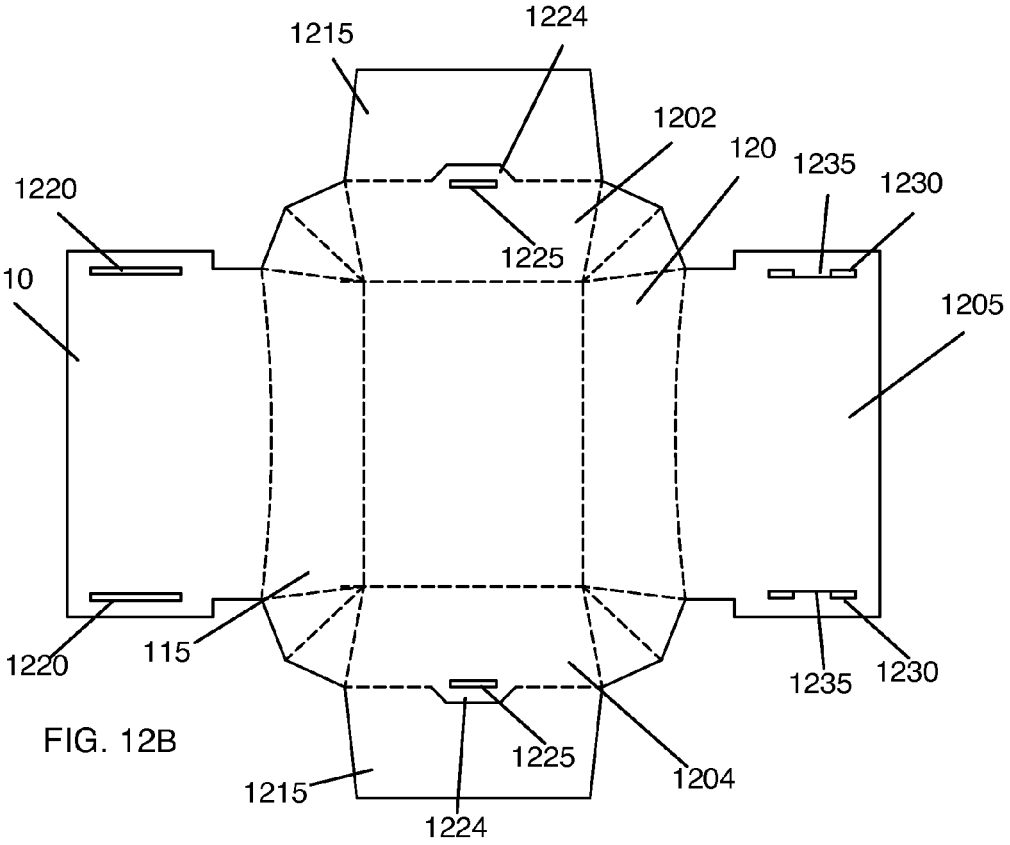
FIG. 12B illustrates the food tray of FIG. 12A in an unassembled configuration.

The first lid member 1205 and the second lid member 1210 are configured to be folded to cover a food item placed within the food tray 1200. Referring to FIG. 12B, the first lid member 1205 defines a pair of slots 1230. Each slot 1230 includes a tab 1235 that extends from one edge of the slot 1230 into a center region of the slot 1230. The second lid member 1220 includes a pair slots 1220 that are configured to overlap the slots 1230 defined by the first lid member 1205 when the first lid member 1205 is folded over the second lid member 1220.

The first sidewall 1202 and the second sidewall 1204 each define an extension section 1224 that defines a slot 1225. A flap 1215 extends from a top edge of the each of the respective sidewalls 1202 and 1204 and is configured to be folded about the top edge.

The extension section 1224 is sized to pass through the slots 1230 and 1220 defined by the first lid member 1205 and the second lid member 1220 when the food tray 1200 is in an assembled configuration, and the respective lid members 1205 and 1210 are folded over one another. The slot 1225 defined by the extension section 1224 is sized to receive the tabs 1235 of the slots 1230 defined by the first lid member 1205, such that when the first lid member 1205 and the second lid member 1210 are folded and the extension section 1224 passes through the respective slots 1230 and 1220 on the respective lid members 1205 and 1210, the tab 1235 extends through the slot 1225 defined by the extension section 1202. In other words, the tab 1235 engages the slot 1225 defined by the extension section 1224 to secure the respective lid members 1205 and 1210 in a closed configuration. Moreover, because the extension section 1224 passes through the slots 1230 and 1220 of both lid members 1205 and 1210, both lid members 1205 and 1210 are prevented from being pushed in when in a closed configuration. This, in turn enables the food tray 1200 to support the weight of additional food trays with food items stored therein as is the case when food trays are stacked.

Figure 13A:
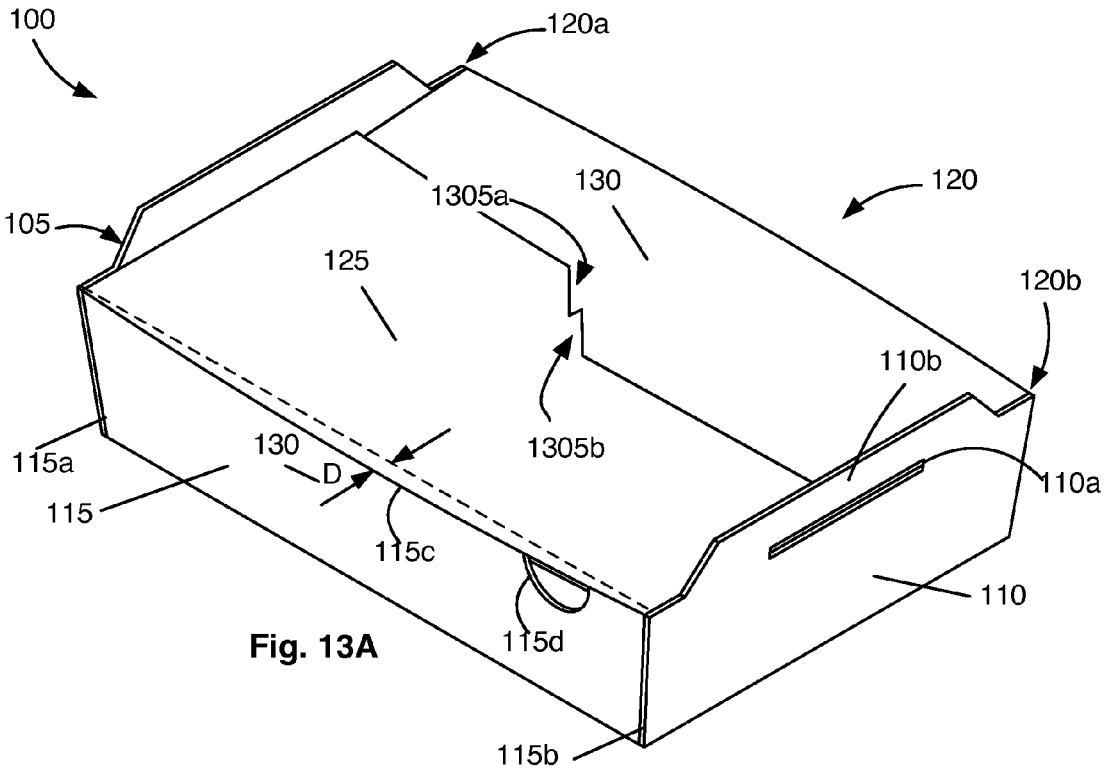
FIG. 13A illustrates a perspective view of an eighth embodiment of a food tray.
Figure 13B:
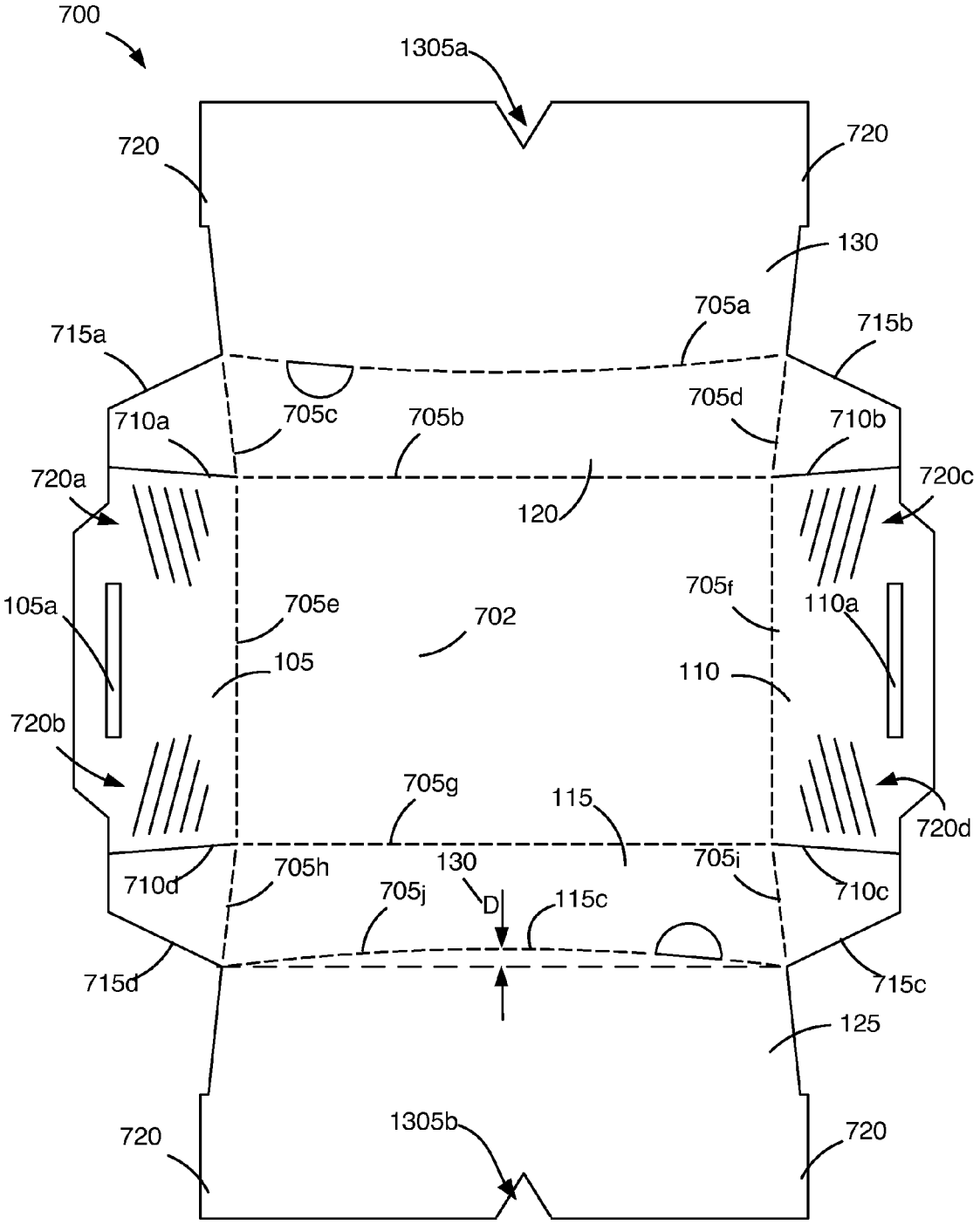
FIG. 13B illustrates the food tray of FIG. 13A in an unassembled configuration.

While various embodiments of the invention have been described, it will be apparent to those of ordinary skill in the art that many more embodiments and implementations are possible that are within the scope of the invention. For example, referring to FIGS. 13*a* and 13*b*, in some embodiments slots 1305*a* and 1305*b* are formed in the first lid member 125 and the second lid member 130. The slots are configured to mesh with one another (FIG. 13A) to facilitate locking of the respective lid members 125 and 130. Locking of the lid members 125 and 130 facilitates a tighter fit between the lid members 125 and 130, thus preventing any slight opening from forming between the respective lid members 125 and 130, due, for example, to board warp. The tighter fit also provides a more visual appealing appearance.

The slots 1305*a* and 1305*b* may have a triangular shape or a different shape that facilities locking of the lid members 125 and 130. The slots 1305*a* and 1305*b* may be positioned along the edge of the respective lid members 125 and 130. The slots 1305*a* and 1305*b* may be provided on any of the food tray embodiments described above.

Figure 14A:
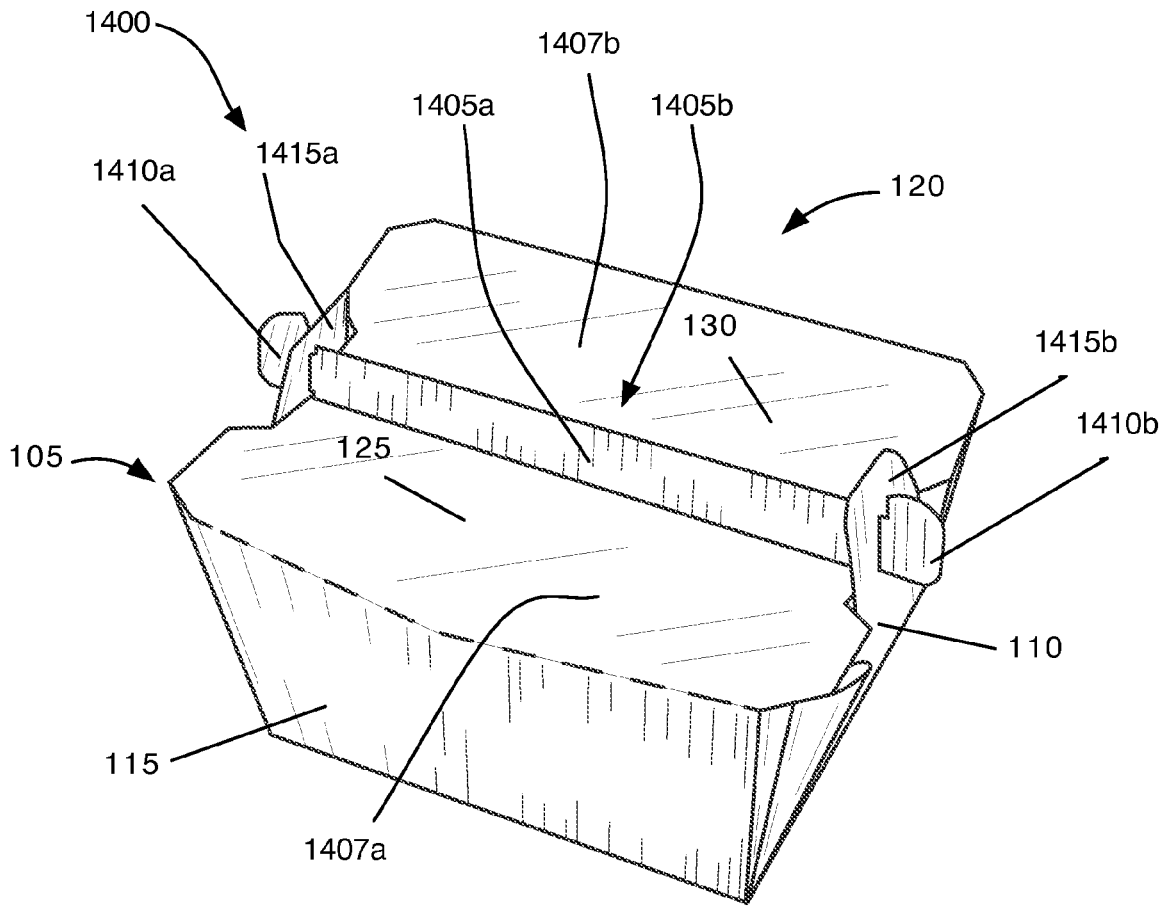
FIG. 14A illustrates a perspective view of a ninth embodiment of a food tray.
Figure 14B:
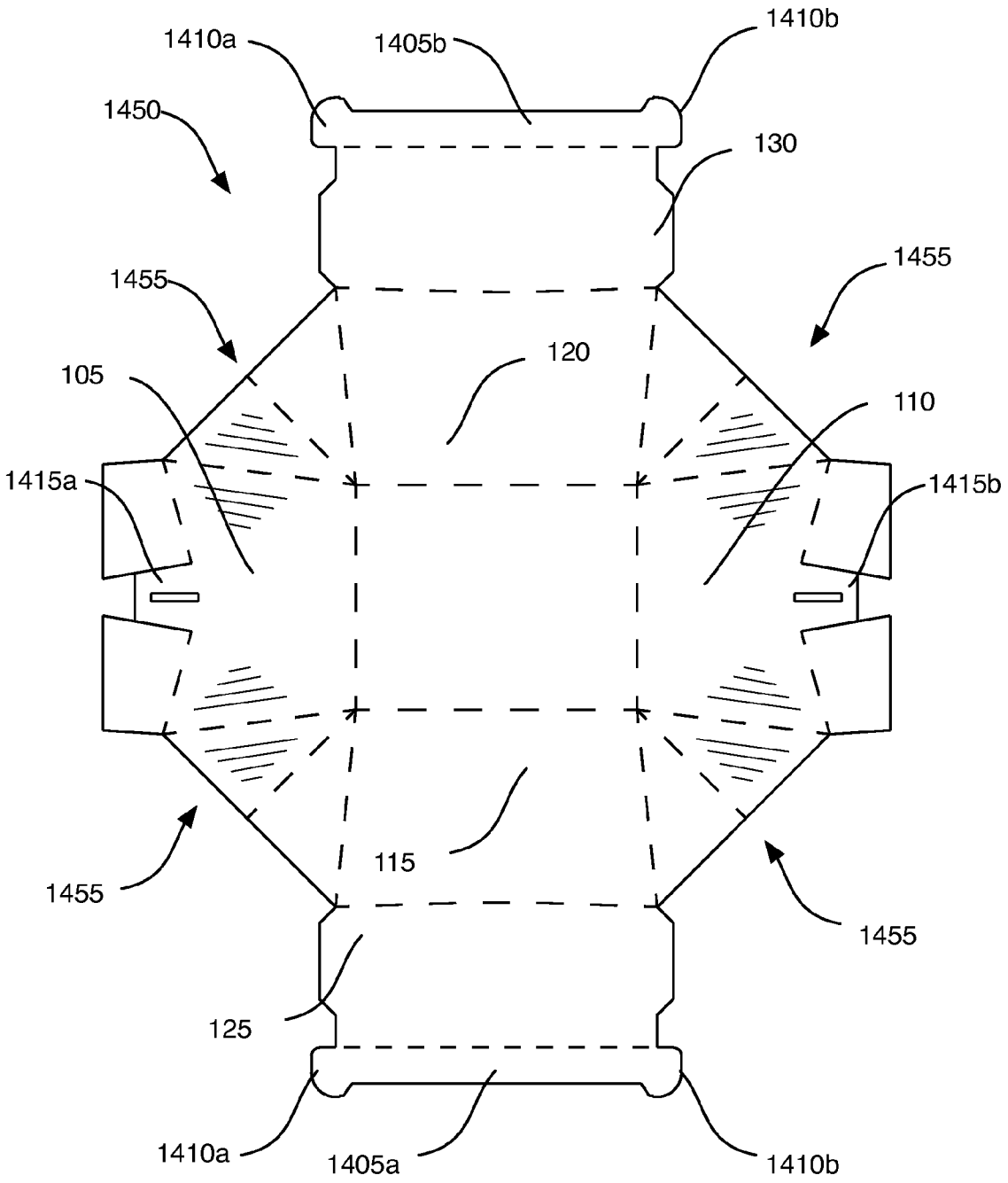
FIG. 14B illustrates the food tray of FIG. 14A in an unassembled configuration.

FIGS. 14A and 14B illustrate yet another embodiment of a food tray 1400. The food tray 1400 includes a first sidewall 105, a second sidewall 110, a front wall 115, a rear wall 120, a first lid member 125, and a second lid member 130. As described above, the first sidewall 105 extends between the respective distal ends of the front wall 115 and the rear wall 120. The second sidewall 110 extends between respective proximal ends the front wall and the rear wall 120.

In some implementations, the first sidewall 105, second sidewall 110, front wall 115, and rear wall 120 may be tapered as described above to enable stacking of the food tray 1400. Other features described with respect to the embodiments described above may be provided.

The first lid member 125 extends from the top edge of the front wall 115, and the second lid member 130 extends from the top edge of the rear wall 120. The first lid member 125 and second lid member 130 each include a horizontal portion 1407*a* and 1407*b* and a flap portion 1405*a* and 1405*b*. Each flap portion 1405*a* and 1405*b* includes first and second tabs 1410*a* and 1410*b*. The first sidewall 105 and second sidewall 110 include an extension member 1415*a* and 1415*b* that define and opening configured to respectively engage the first and second tabs 1410*a* and 1410*b* to lock first lid member 125 and second lid member 130 in a closed configuration. In the closed configuration, the horizontal portions 1407*a* and 1407*b* are configured to substantially close the top of the food tray 1400. Surfaces of the flap portions 1405*a* and 1405*b* are held in contact with one another via the elastic force described above that occurs as a result of the bowing of the front wall 115 and the rear wall 120 to thereby form a vertical rib that extends perpendicular to top of the food tray 1400. The elastic force helps to maintain the surfaces of the flaps 1405*a* and 1405*b* against one another to thereby improve sealing of the food tray 1400.

As illustrated in FIG. 14B, the food tray 1400 may be formed from a single sheet 1450 of material, such as a corrugated paper material. The sheet 1450 may define a group of creases as described above and shown in dashed lines that further define the first sidewall 105, second sidewall 110, front wall 115, rear wall 120, first lid member 125, second lid member 130, and respective flaps 1405*a* and 1405*b* that define the vertical rib described above. The sheet 1450 may define a group of gussets 1455 for sealing respective corners of the food tray.

Figure 15A:
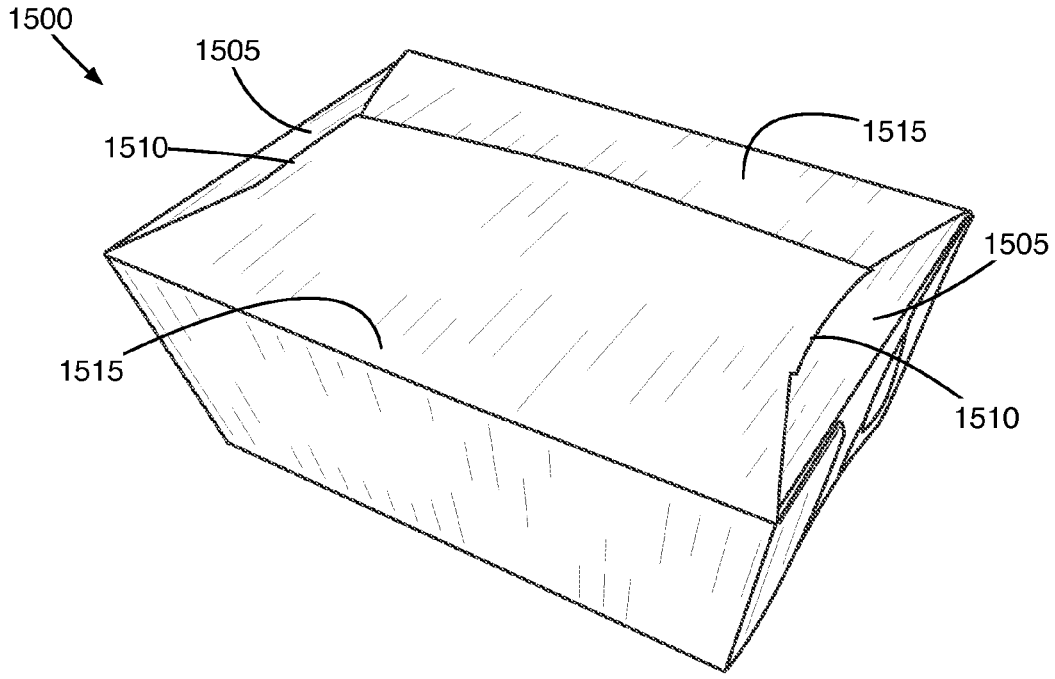
FIG. 15A illustrates a perspective view of a tenth embodiment of a food tray.
Figure 15B:
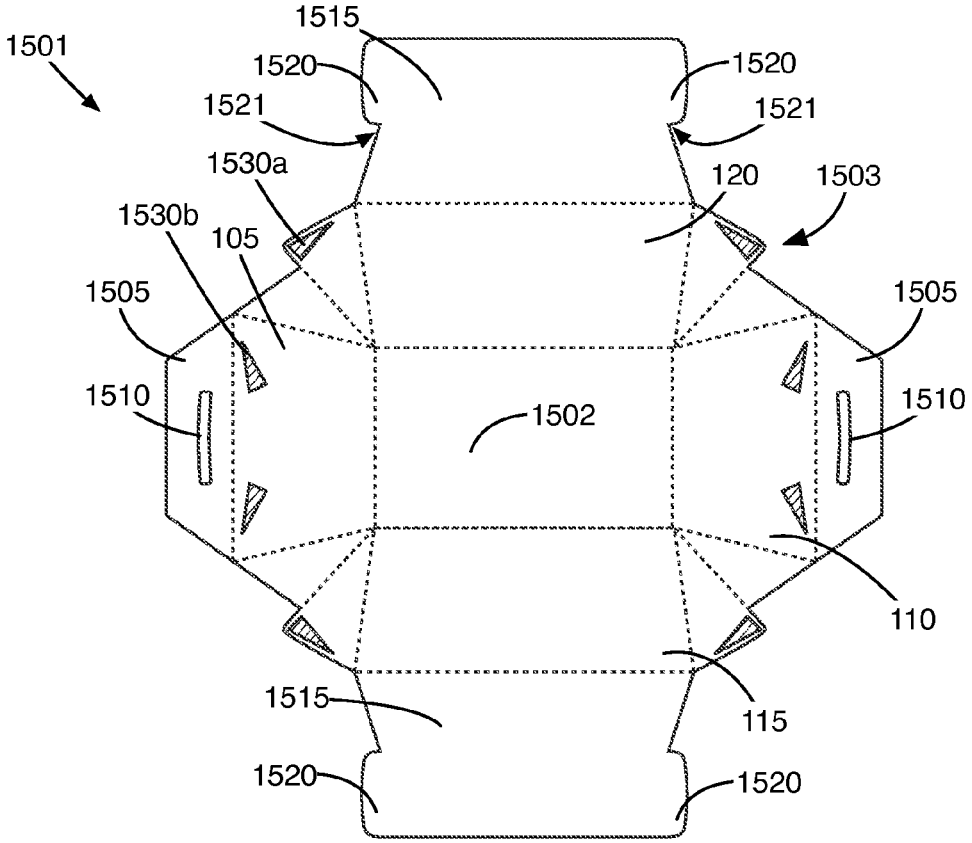
FIG. 15B illustrates the food tray of FIG. 15A in an unassembled configuration.

FIG. 15A illustrates yet another food tray embodiment 1500 in an assembled configuration. FIG. 15B illustrates a blank 1501 from which the food tray 1500 is formed. The dashed lines in the blank 1501 correspond to fold lines that define the respective members of the food tray 1500. The blank 1501 may be formed of a fluted or non-fluted material, such as corrugated paper, paperboard, chipboard, or any other material suitably rigid to hold the shape of a food tray. The material may be biodegradable or non-biodegradable.

Referring to FIGS. 15A and 15B, the food tray 1500 includes a first sidewall 105, a second sidewall 110, a front wall 115, a rear wall 120, a pair of lid member 1515, a pair of flaps 1505, and a bottom panel 1502. The bottom panel 1502 is generally rectangular. The sidewalls (105, 110), front wall 115, and rear wall 120 extend from the bottom panel 1502. The flaps 1505 extend from the first sidewall 105 and the second sidewall 110, respectively. The lid members 1515 extend from the front wall 115 and the rear wall 120, respectively. The respective walls members may be sized and positioned relative to one another in a similar manner as in any of the embodiments described above.

The food tray 1500 includes a group of gussets 1503 on corners of the food tray 1500 that may be configured similar to the gussets described above. The gussets 1503 may be folded outwardly to be visible from outside of the food tray 1500, as illustrated, or inwardly so that they are not visible when the food tray 1500 is closed. Glue strips (1530*a*, 1530*b*) or some other form of adhesive may be provided on the gussets and the sidewalls (105, 110) to secure the gussets to the sidewalls. Alternatively, glue strips or the other form of adhesive may be provided on the front and rear walls (115, 120) to secure the gussets to the front and rear walls (115, 120). In some implementations, a polyethylene coating applied to the food tray 1500 as a moisture barrier may be utilized as the adhesive for securing the gussets to the sidewalls rather than or in addition to glue strips. For example, heat may be applied to the gussets 1503 and/or the opposing sidewall to which the gussets are to be secured to cause the polyethylene to bond. The gussets are then brought in contact with the opposing sidewalls and the polyethylene is allowed to cool, thus securing the gussets 1503 to the opposing sidewalls. The food tray 1500 may be combined other elements of the food tray embodiments described above.

The flaps 1505 are configured to be folded towards an interior of the food tray 1500. In this configuration, the flaps 1505 form a shelf that extends toward the center of the food tray 1500. The shelf provides support for the lid members 1505, which are configured to be folded over the flaps 1505 and each other. Each flap 1505 defines a slot 1510 in a middle region. The slots 1510 may define the shape of an arc. Each lid member 1515 includes a pair tabs 1520 that are configured to engage the slots 1510 of the flaps 1505 to secure the lid members 1515 to the flaps 1505 and thereby seal the top of the food tray 1500. The outside edges of the tabs 1520 are curved and cooperate with the arc shaped slots 1510 to facilitate smoother insertion of the tabs 1520 into the slots 1510, and to minimize tearing of the tabs 1520 that might otherwise occur during opening and closing the food tray 1500.

The tabs 1520 define hook regions 1521 that are configured to hook within the slots 1510 after insertion. Hooking of the tabs 1520 to the slots 1510 helps prevent unintended opening of the lid member. Once hooked, the tabs 1520 may be removed from the slots 1510 by, for example, applying pressure against the front and rear walls (115, 120) to unhook the tabs 1520 from the slots and then by pinching the lid members 1515 so as to pull the tabs 1520 out of the slots 1510.

Figure 16A:
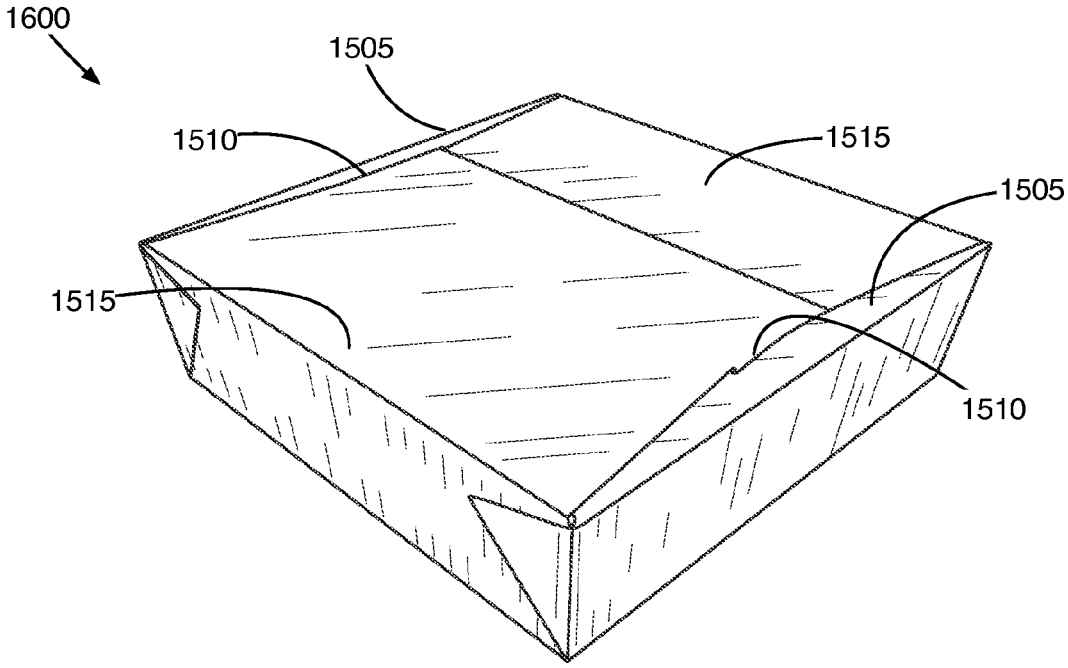
FIG. 16A illustrates a perspective view of a eleventh embodiment of a food tray.
Figure 16B:
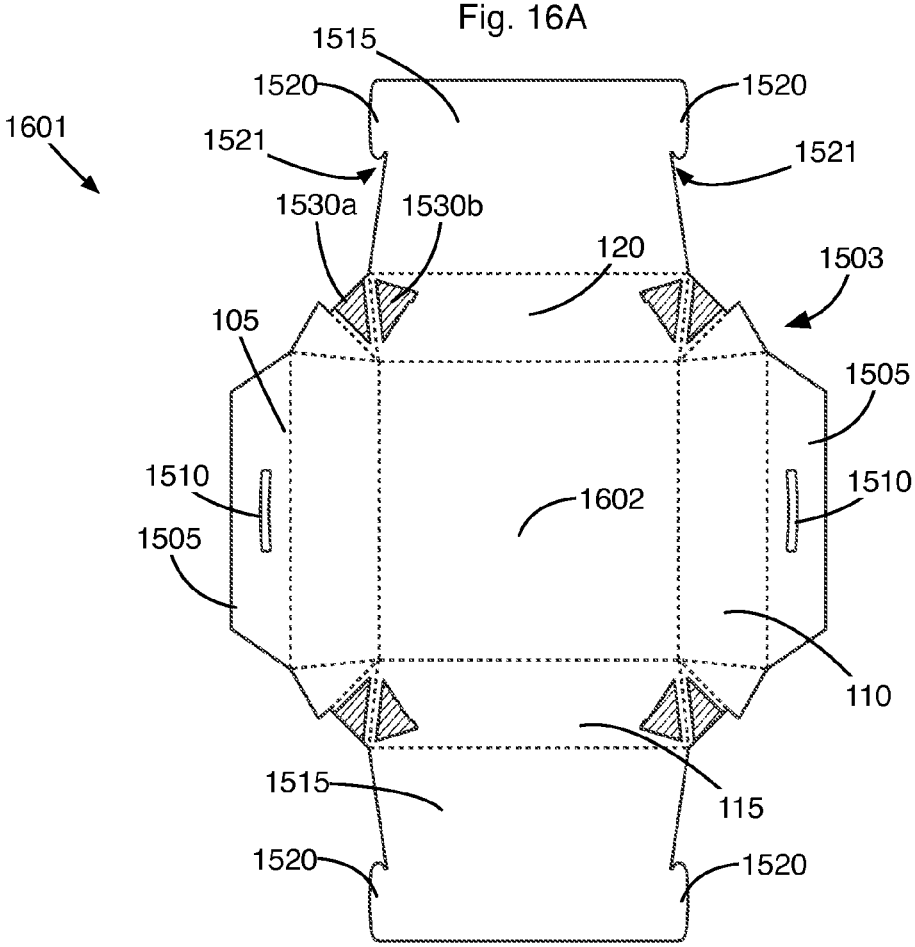
FIG. 16B illustrates the food tray of FIG. 16A in an unassembled configuration.
Figure 17A:
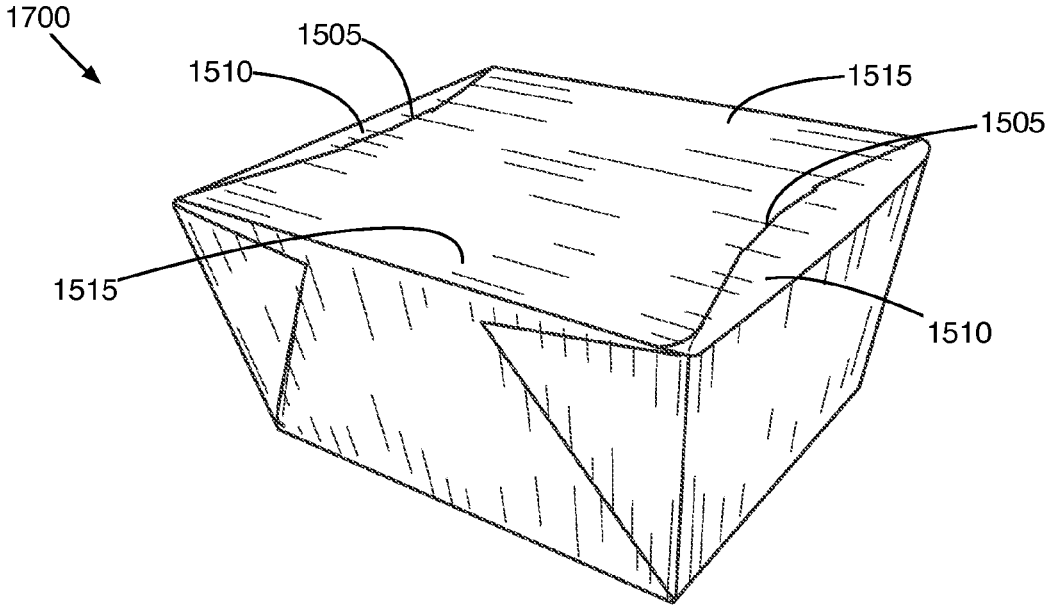
FIG. 17A illustrates a perspective view of a twelfth embodiment of a food tray.
Figure 17B:
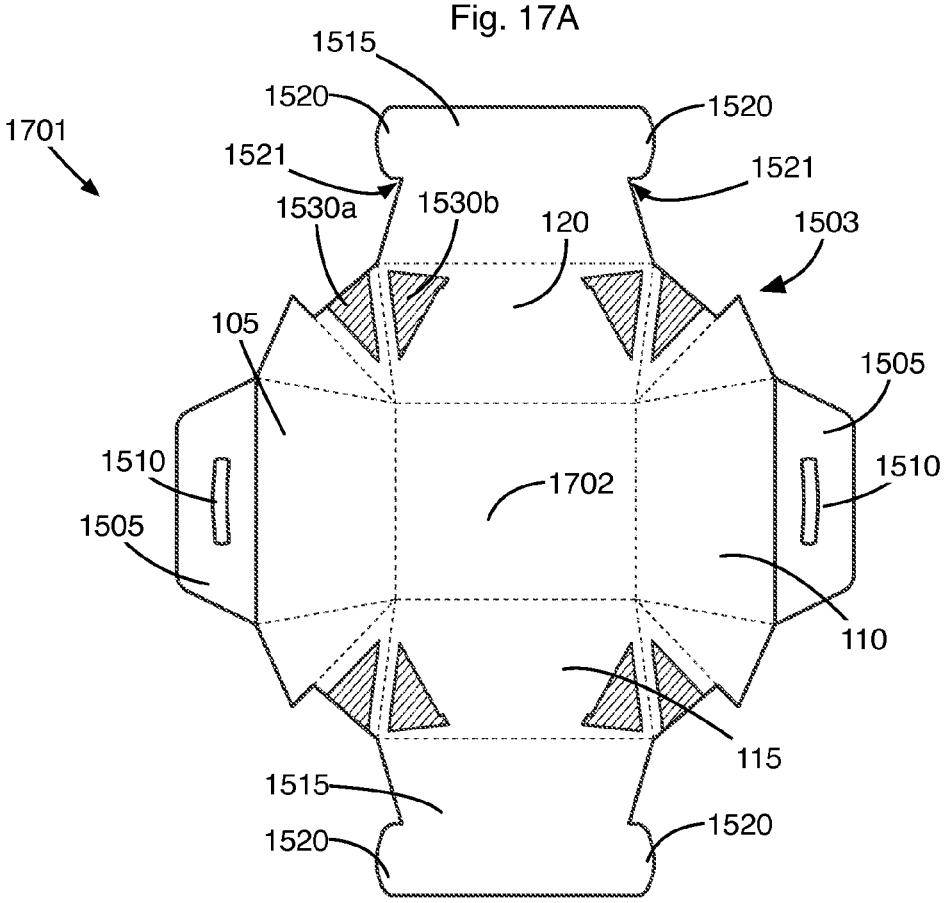
FIG. 17B illustrates the food tray of FIG. 17A in an unassembled configuration.

FIGS. 16 and 17 illustrate alternative food trays 1600 and 1700 that generally include the features of the food tray 1500 illustrated in FIG. 15. However, the size and general shape of the respective food trays may be different. For example, the food tray blank 1501 of FIG. 15B may have a generally square geometry. And when folded the food tray 1500 may have a generally rectangular shape as evinced by the generally rectangular bottom panel 1502. The food tray blank 1601 illustrated in FIG. 16B may have a generally square geometry. And when folded, the food tray 1600 may have a generally square shape as evinced by the generally square bottom the bottom panel 1602. The food tray 1700 illustrated in FIG. 17B is a smaller version of the food tray 1600 illustrated in FIG. 16B. The food tray blank 1701 illustrated in FIG. 17B may have a generally square geometry. And when folded, the food tray 1700 may have a generally square shape as evinced by the generally square bottom the bottom panel 1702. Although, in other implementations, the food tray blank may have a multifaceted geometry.

Figure 18A:
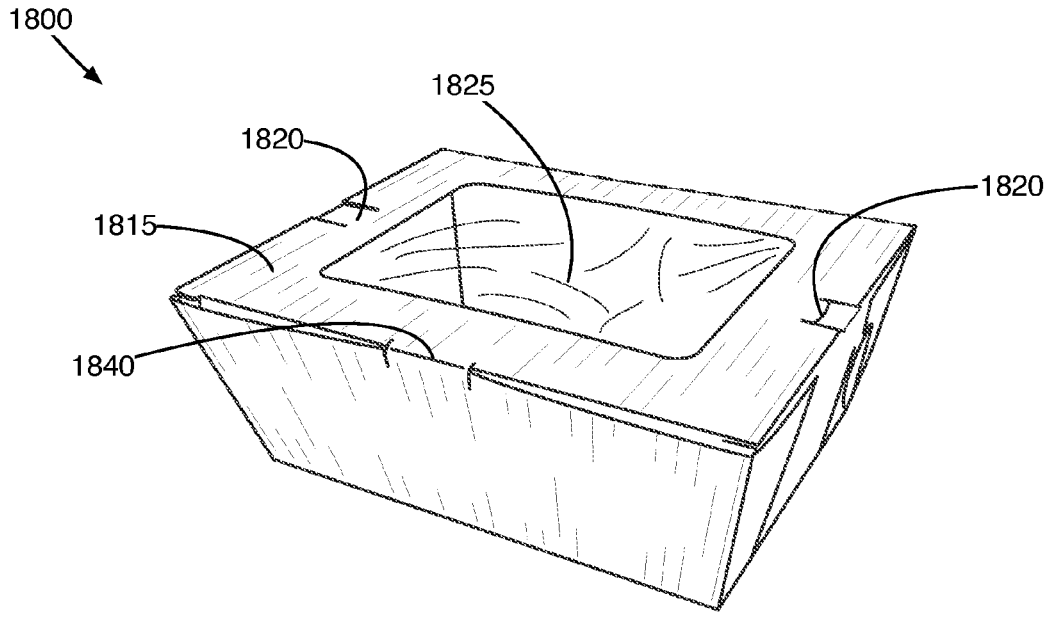
FIG. 18A illustrates a perspective view of a thirteenth embodiment of a food tray.
Figure 18B:
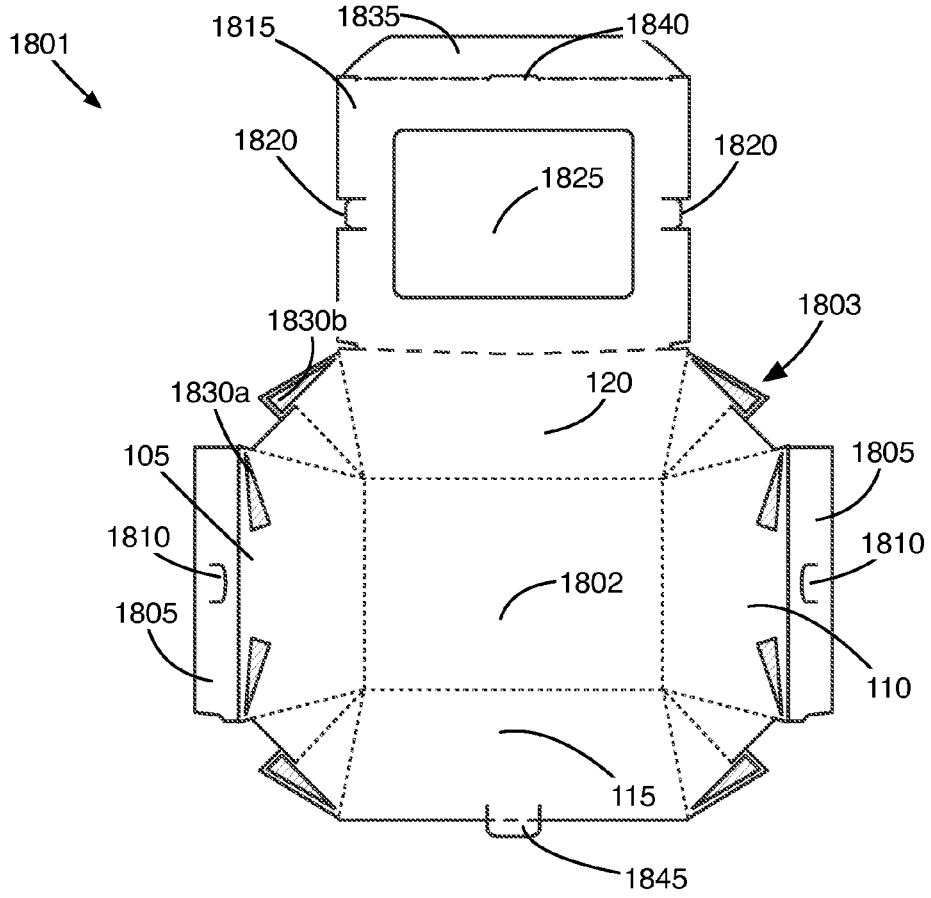
FIG. 18B illustrates the food tray of FIG. 18A in an unassembled configuration.

FIG. 18A illustrates yet another food tray embodiment 1800 in an assembled configuration. FIG. 18B illustrates a blank 1801 from which the food tray 1800 is formed. The fold lines in the blank 1801 correspond to fold lines that define the respective members of the food tray 1800.

Referring to FIGS. 18A and 18B, the food tray 1800 includes a first sidewall 105, a second sidewall 110, a front wall 115, a rear wall 120, a lid member 1815, a pair of flaps 1805, and a bottom panel 1802. The bottom panel 1802 is generally rectangular. The sidewalls (105, 110), front wall 115, and rear wall 120 extend from the bottom panel 1802. The respective walls members may be sized and positioned relative to one another in a similar manner as the respective walls members described in the embodiments above. The food tray 1800 also includes a group of gussets 1803 on corners of the food tray 1800 that may be configured similar to the gussets described in any of the other embodiments disclosed herein. The gussets 1803 may be secured to opposing sidewalls via glue strips (1830*a*, 1830*b*) as described above.

Figure 18C:
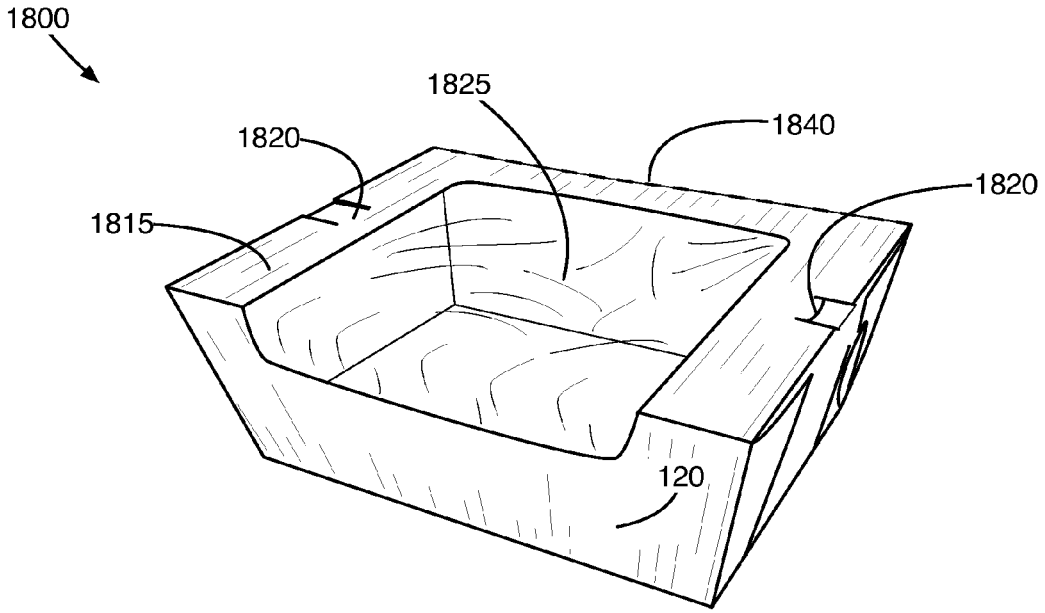
FIG. 18C illustrates a rear perspective view of a version of the thirteenth embodiment of the food tray that has a clear lid that partially wraps around the rear wall.
Figure 18D:
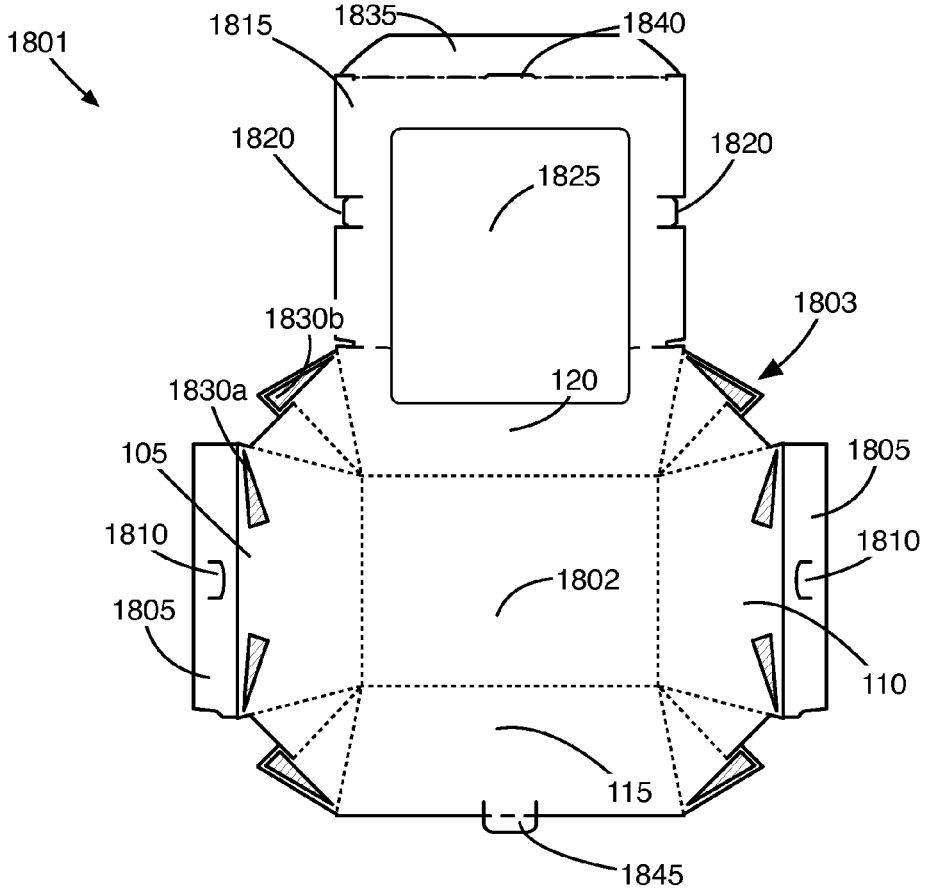
FIG. 18D illustrates the food tray of FIG. 18C in an unassembled configuration.

The lid member 1815 extends from a top edge of the rear wall 120. The lid member 1815 may include a window 1825 formed of a clear material that facilitates viewing of contents stored within the food tray 1800. In some implementations, the window 1825 may extend beyond the edge of the lid member to one of the sidewalls. For example, as illustrated in FIGS. 18C and 18D, the window 1825 may extend partially into the rear wall 120. Extending the window 1825 to a sidewall advantageously facilitates viewing of contents stored in with the food tray 1800 when the food tray 1800 is stacked.

The lid member 1815 includes a flap 1835 that extends from an edge of the lid member 1815 that is opposite the top edge of the rear wall 120. A slot 1840 is formed in a central region of the edge from which the flap 1835 extends. The slot 1840 is sized to received a tab 1845 that extends from a top edge of the front wall 115. The lid member 1815 also includes a pair tabs 1820 on side edges that are recessed somewhat relative to the side edges.

Flaps 1805 extend from the first sidewall 105 and the second sidewall 110, respectively. The flaps 1805 are configured to be folded towards an interior of the food tray 1800. In this configuration, the flaps 1805 form a shelf that extends toward the center of the food tray 1800. The shelf provides support for the lid member 1805 when the lid member 1805 is folded over the flaps 1805. Each flap 1805 defines a slot 1810 or cutout in a middle region. The slots 1810 are sized to receive the tabs 1820 of the lid member 1815.

In operation, when closing the food tray 1800, the flaps 1805 that extend from the sidewalls (105, 110) are folded inwardly towards the center of the food tray 1800. The lid member 1815 is then folded to close the food tray 1800. The flap 1835 of the lid member is folded so that it is behind the front wall 115 when the lid member 1815 is closed. The lid member 1815 may then be warped slightly to facilitate insertion of the tabs 1820 into the slots 1810. Once released, the slots 1810 and tabs 1820 cooperate to secure the lid member 1815 to the flaps 1805 and thereby seal the top of the food tray 1800. The tab 1845 that extends from the front wall 115 is then inserted into the slot 1840 of the lid member 1815 to further secure the lid member to the front wall 115. Thus, the lid member 1815 is secured along all four walls of the food tray 1800.

Figure 19A:
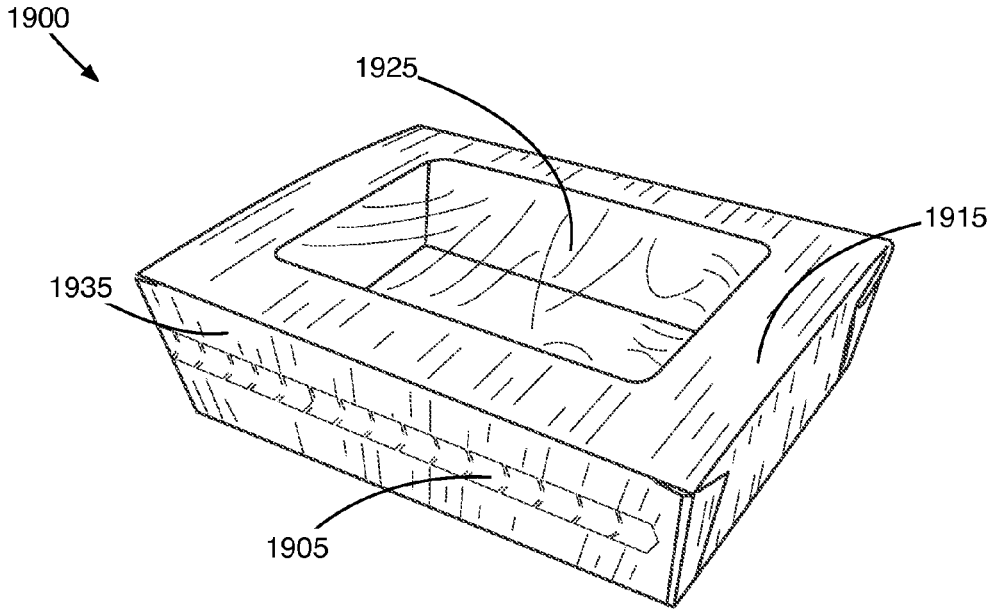
FIG. 19A illustrates a perspective view of a fourteenth embodiment of a food tray.
Figure 19B:
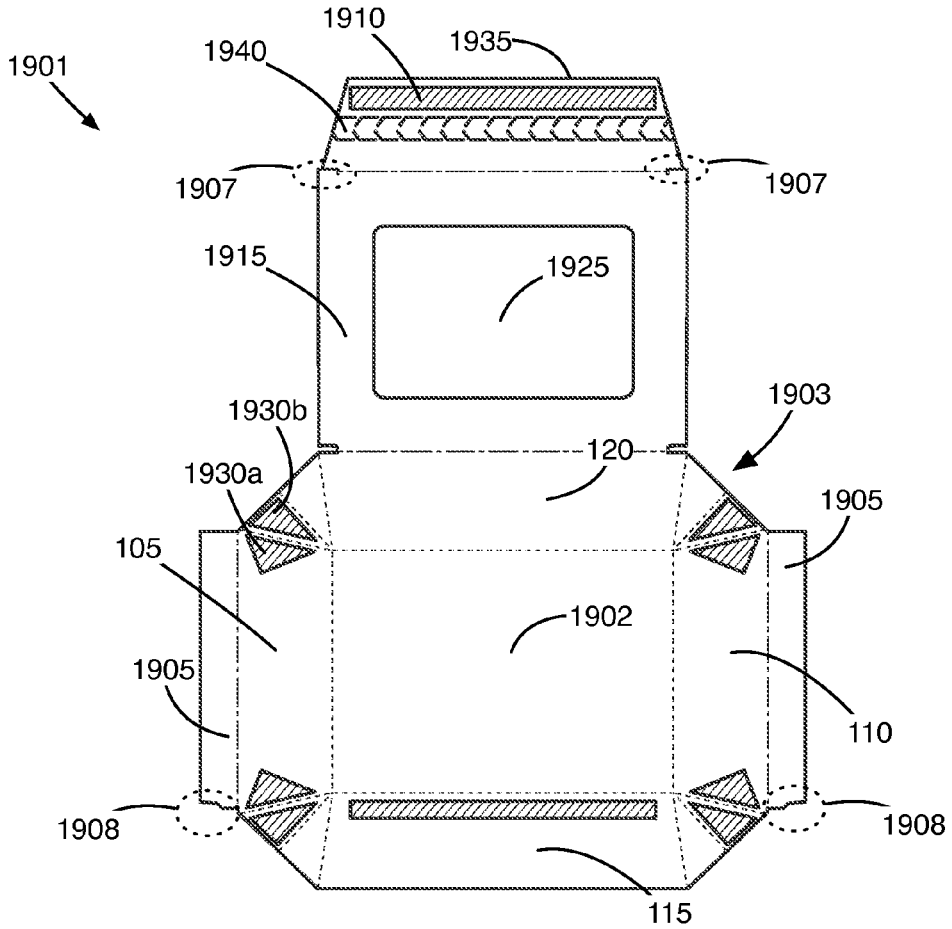
FIG. 19B illustrates the food tray of FIG. 19A in an unassembled configuration.

FIG. 19A illustrates yet another food tray embodiment 1900 in an assembled configuration. FIG. 19B illustrates a blank 1901 from which the food tray 1900 is formed. The fold lines in the blank 1901 correspond to fold lines that define the respective members of the food tray 1900.

Referring to FIGS. 19A and 19B, the food tray 1900 includes a first sidewall 105, a second sidewall 110, a front wall 115, a rear wall 120, a lid member 1915, a pair of flaps 1905, and a bottom panel 1902. The bottom panel 1902 is generally rectangular. The sidewalls (105, 110), front wall 115, and rear wall 120 extend from the bottom panel 1902. The respective walls members may be sized and positioned relative to one another in a similar manner as the respective walls members of any of the food tray embodiments described above. The food tray 1900 also includes a group of gussets 1903 on corners of the food tray 1900 that may be configured similar to the gussets of any of the food tray embodiments described above and secured via glue strips (1930*a*, 1930*b*).

The lid member 1915 extends from a top edge of the rear wall 120. The lid member 1915 may include a window 1925 formed of a clear material that facilitates viewing of contents stored within the food tray 1900. A flap 1935 extends from an edge of the lid member 1915 that is opposite the top edge of the rear wall 120. The flap 1935 defines a tear strip 1940 that extends substantially the entire length of the flap 1935 in a direction that is parallel to the edge. The tear strip 1940 is a perforated portion of the flap that facilitates easy and controlled separation of the flap 1935 from the lid member 1915. A glue strip 1910 is positioned adjacent to the tear strip 1940 on a side of the tear strip 1940 that is opposite the edge that separates the flap 1935 from the lid member 1915. The glue strip 1910 may extend for the length of the flap or a lesser length. While illustrated on the flap 1935, in alternative embodiments, the glue strip 1910 may be arranged instead on the front wall 115 or both the front wall 115 and the flap 1935.

Flaps 1585 extend from the first sidewall 105 and the second sidewall 110, respectively. The flaps 1905 are configured to be folded towards an interior of the food tray 1900. In this configuration, the flaps 1905 form a shelf that extends toward the center of the food tray 1900. The shelf provides support for lid member 1915 when the lid member 1915 is folded over the flaps 1905. Each flap 1905 defines a notched portion 1907 configured to enter within a respective slot 1907 formed in the outside ends of the edge between the lid member 1915 and the flap 1935, when the lid member 1915 is closed.

In operation, when closing the food tray 1900, the flaps 1905 that extend from the sidewalls (105, 110) are folded inward towards the center of the food tray 1900. The lid member 1915 is then folded to close the food tray 1900. The flap 1935 that extends from the lid member is folded so that it is in front of the front wall 115 when the lid member 1915 is closed. That is, the flap 1935 is disposed on the outside of the food tray 1900. The flap 1935 is pressed against the outside surface of the front wall 115 to secure the lid member 1915 to the front wall 115 via the glue strip 1910. The tear strip 1940 is configured to provide a user friendly and tamper evident method of separating the portion of the flap 1935 that is secured to the front wall 115 from the portion that is attached to the lid member 1915 to facilitate opening of the lid member 1915. After opening, the lid member 1915 may be re-secured to the front wall 115 via interlocking of the notched portion 1908 of the flaps 1905 that extend from the first sidewall 105 and the second side wall 110 and the slots 1907 formed between the lid member 1915 and the flap 1935 that extends from the lid member 1915.

Many other modifications may be provided to one or more of the food tray embodiments described above. For example, gusseted sides may or may not be provided. When provided, the gussets may be configured to be positioned inside the food tray or outside the food tray. The respective sheets from which the respective food trays are formed may be made from paperboard, micro-fluted paperboard coated with a water and/or grease barrier coating or lamination, or an uncoated paperboard or microfluted paperboard, or a type of plastic. The food trays may be formed of corrugated paper, chipboard or other suitably rigid material. The features of the various food trays may be combined in various ways to provide any of the advantages described above in any of the food tray embodiments. Other modifications may be made without departing from the scope of the claims.

We claim:

1. A food tray formed of a unitary sheet of material comprising:

a front wall with a distal end and a proximal end, and a rear wall with a distal end and a proximal end;

a first sidewall that extends between the distal end of the front wall and the distal end of the rear wall, and a second sidewall that extends between the proximal end of the front wall and the proximal end of the rear wall, wherein the front wall, rear wall, first sidewall, and second sidewall define an opening through which an item is placed in the food tray;

a bottom wall extending between the front wall, rear wall, first sidewall, and second sidewall;

first and second flaps that extend from respective top edges of the first and second sidewalls, the first and second flaps configured to be folded toward an interior of the food tray, wherein each of the first and second flaps defines a slot;

a lid member that extends from a top edge of the rear wall, wherein the lid member is configured to be folded toward the interior of the food tray, wherein the lid member defines a pair of tabs on respective side edges of the lid member that are configured to engage the slots defined by the first and second flaps when the lid member is folded over the opening to thereby secure the lid member to the first and second flaps; and a third flap that extends from an edge of the lid member that is opposite the top edge of the rear wall, wherein the third flap is configured to be folded about the lid member edge so that when the lid member is secured to the first and second flaps, the third flap is disposed in the interior of the food tray, wherein the edge from which the third flap extends defines a slot in a middle region that is configured to receive a tab that extends from a top edge of the front wall to secure the lid member to the front wall, wherein the lid member and rear wall define an opening, and wherein a window of clear material spans the opening to facilitate viewing of an item within the food tray through the both the lid member and the rear wall, the opening has a first edge in the lid member adjacent and extending parallel to the lid member edge from which the third flap extends and in which the slot is formed, a second edge in the rear wall extending parallel to the first edge, and third and fourth edges extending between opposite respective ends of the first and second edges;

the first and second edges of the opening being spaced from the top edge of the rear wall such that a portion of the opening extending between the first edge, the third edge, the fourth edge, and the top edge of the rear wall is larger than a portion of the opening extending between the second edge, the third edge, the fourth edge, and the top edge of the rear wall.

2. The food tray according to claim 1, wherein the front wall, rear wall, first sidewall, and second sidewall are tapered to enable the insertion of a second food tray into the opening.

3. The food tray according to claim 1, further comprising a plurality of gussets formed on respective corners of the food tray.

4. The food tray according to claim 1, wherein the unitary sheet comprises a material from the group consisting of: coated or uncoated corrugated paper, paperboard, chipboard, and plastics.

5. The food tray according to claim 1, wherein the unitary sheet of material has a generally square shape.

6. The food tray according to claim 1, wherein the unitary sheet of material has a generally rectangular shape.

7. The food tray according to claim 1, wherein the lid member includes opposite pairs of spaced-apart slits in the respective side edges thereof that form opposite sides of the tabs.

8. The food tray according to claim 1, wherein the tabs each have an outward edge recessed from the corresponding side edge of the lid member.

9. A food tray formed of a unitary sheet of material comprising:

a front wall with a distal end and a proximal end, and a rear wall with a distal end and a proximal end;

a first sidewall that extends between the distal end of the front wall and the distal end of the rear wall, and a second sidewall that extends between the proximal end of the front wall and the proximal end of the rear wall, wherein the front wall, rear wall, first sidewall, and second sidewall define an opening through which an item is placed in the food tray;

a bottom wall extending between the front wall, rear wall, first sidewall, and second sidewall;

first and second flaps that extend from respective top edges of the first and second sidewalls, the first and second flaps configured to be folded toward an interior of the food tray;

a lid member that extends from a top edge of the rear wall, wherein the lid member is configured to be folded toward the interior of the food tray;

a third flap that extends from an edge of the lid member that is opposite the top edge of the rear wall, wherein the third flap includes a tear strip that extends along a length of the third flap that is parallel to the edge, wherein the third flap is configured to be folded about the edge of the lid member that is opposite the top edge of the rear wall when the lid member is folded toward the interior of the food tray, and secured to an outside surface of the front wall via an adhesive strip, wherein the tear strip is configured to facilitate tearing of the third flap to facilitate opening of the lid member, wherein the lid member and rear wall define an opening, and wherein a clear material spans the opening to facilitate viewing of an item within the food tray through the both the lid member and the rear wall;

first and second slots formed between the lid member and the third flap extending inward from respective outer side edges thereof; and lid securement portions at a side edge of each of the first and second flaps configured to be inserted within the respective first and second slots when the lid member is closed to secure the lid member in a closed configuration after removal of the tear strip.

10. The food tray according to claim 9, wherein the adhesive strip is disposed on the third flap.

11. The food tray according to claim 9, wherein the adhesive strip is disposed on the front wall.

12. The food tray according to claim 9, wherein the front wall, rear wall, first sidewall, and second sidewall are tapered to enable the insertion of a second food tray into the opening for stacking or nesting.

13. The food tray according to claim 9, further comprising a plurality of gussets formed on respective corners of the food tray.

14. The food tray according to claim 9, wherein the unitary sheet comprises a material from the group consisting of: coated or uncoated corrugated paper, paperboard, chipboard, and plastics.

15. The food tray according to claim 9, wherein the lid securement portions comprise notched portions configured to fit within the first and second slots for securing the lid member in the closed configuration.

16. The food tray according to claim 9, wherein the lid securement portions are located on the side edges of the respective first and second flaps nearest to the front wall.

* * * * *